US011013075B2

(12) United States Patent
Lester et al.

(10) Patent No.: US 11,013,075 B2
(45) Date of Patent: May 18, 2021

(54) RF APPARATUS WITH ARC PREVENTION USING NON-LINEAR DEVICES

(71) Applicant: NXP USA, Inc., Austin, TX (US)

(72) Inventors: David Paul Lester, Phoenix, AZ (US); Lionel Mongin, Chandler, AZ (US)

(73) Assignee: NXP USA, Inc., Austin, TX (US)

( * ) Notice: Subject to any disclaimer, the term of this patent is extended or adjusted under 35 U.S.C. 154(b) by 390 days.

(21) Appl. No.: 16/228,482

(22) Filed: Dec. 20, 2018

(65) Prior Publication Data

US 2020/0205243 A1 Jun. 25, 2020

(51) Int. Cl.
*H05B 6/70* (2006.01)
*H05B 6/66* (2006.01)

(52) U.S. Cl.
CPC ..... *H05B 6/666* (2013.01)

(58) Field of Classification Search
CPC . H05B 6/50; H05B 6/62; H05B 6/645; H05B 6/647; H05B 6/664; H05B 6/666; H05B 6/68; H05B 6/685; H05B 6/686; H05B 6/687; H05B 6/688; H05B 6/70; H05B 6/705; H05B 6/72; H05B 6/80
USPC ..... 219/695, 696, 697, 709, 715, 716, 746, 219/750
See application file for complete search history.

(56) References Cited

U.S. PATENT DOCUMENTS

| | | | |
|---|---|---|---|
| 2,868,941 | A | 1/1959 | Hickok |
| 5,192,894 | A | 3/1993 | Teschner |
| 6,784,405 | B2 | 8/2004 | Flugstad et al. |
| 7,305,311 | B2 | 12/2007 | van Zyl |
| 7,368,918 | B2 | 5/2008 | Henson et al. |
| 8,207,479 | B2 | 6/2012 | Ben-Shmuel et al. |
| 8,334,700 | B2 | 12/2012 | Coumou et al. |
| 9,215,756 | B2 | 12/2015 | Bilchinsky et al. |
| 10,677,822 | B2 | 6/2020 | Clarke et al. |
| 2004/0031699 | A1 | 2/2004 | Shoji |
| 2004/0074900 | A1 | 4/2004 | Suenaga et al. |
| 2006/0081624 | A1 | 4/2006 | Takada et al. |
| 2009/0308734 | A1 | 12/2009 | Krauss |
| 2012/0122072 | A1 | 5/2012 | Bilchinsky et al. |
| 2015/0351164 | A1 | 12/2015 | Wesson et al. |

(Continued)

FOREIGN PATENT DOCUMENTS

| | | | |
|---|---|---|---|
| CN | 108521691 | A | 9/2018 |
| CN | 108812854 | A | 11/2018 |

(Continued)

OTHER PUBLICATIONS

U.S. Appl. No. 16/131,636; Not Yet Published; 94 pages (filed Sep. 14, 2018).

*Primary Examiner* — Hung D Nguyen

(57) ABSTRACT

An RF system includes an RF signal source and a single-ended or double-ended impedance matching network. Non-linear devices, such as gas discharge tubes, are coupled in parallel with components of the impedance matching network. The non-linear devices are insulating below a breakdown voltage and conductive above the breakdown voltage. The system also includes measurement circuitry configured to measure one or more parameters that reflect changes in the impedance of the impedance matching network. A system controller modifies operation of the system when a rate of change of any of the monitored parameter(s) exceeds a predetermined threshold.

19 Claims, 7 Drawing Sheets

(56) References Cited

U.S. PATENT DOCUMENTS

| | | | | |
|---|---|---|---|---|
| 2016/0248396 | A1* | 8/2016 | Mavretic | H01L 21/67115 |
| 2018/0062605 | A1* | 3/2018 | Brounley | H05B 6/687 |
| 2018/0220499 | A1* | 8/2018 | Sims | H05B 6/50 |
| 2019/0191501 | A1 | 6/2019 | Piel et al. | |

FOREIGN PATENT DOCUMENTS

| | | | |
|---|---|---|---|
| CN | 108924982 | A | 11/2018 |
| GB | 592664 | A | 9/1947 |
| JP | H09283339 | A | 10/1997 |
| JP | 2004220923 | A | 8/2004 |
| JP | 2005158326 | A | 6/2005 |

* cited by examiner

RF APPARATUS WITH ARC PREVENTION USING NON-LINEAR DEVICES

TECHNICAL FIELD

Embodiments of the subject matter described herein relate generally to apparatus and methods of preventing and/or detecting arc events in a radio frequency (RF) system.

BACKGROUND

Various types of conventional radio frequency (RF) systems that can produce high RF voltages have the potential for arcing within a load coupled to or contained within the system, and within the system itself. In such conventional RF systems, arcing may occur at high voltage nodes or points within the device circuitry, which may result in potentially irreversible damage to circuit components or to grounded structures. This arcing may be sustained over an extended period of time, which may result in poor system performance. Additionally, sustained electrical arcing may damage circuit components and present additional problems. In some cases, such arcing has the potential to cause permanent impairment of system functionality. What are needed are apparatus and methods for detecting conditions that may lead to electrical arcing occurring in an RF system or apparatus, and for taking proactive measures to prevent arcing between, across or through system components.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures.

DETAILED DESCRIPTION

Figure 1:
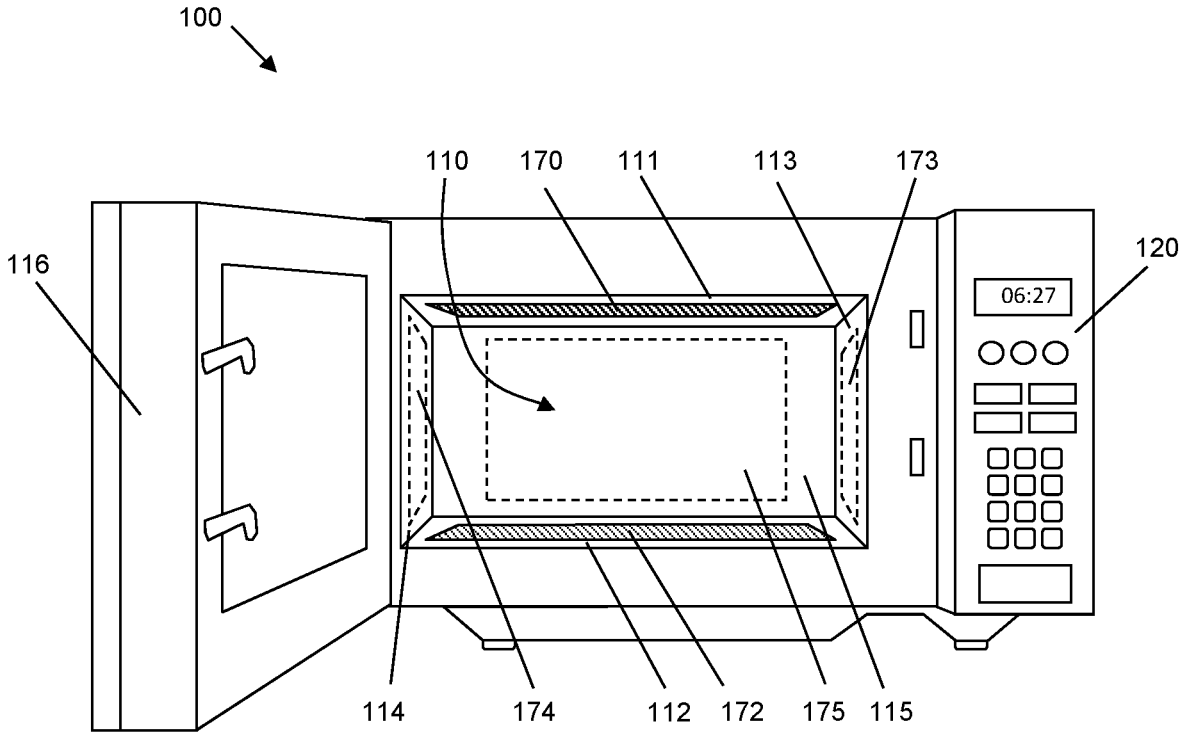
FIG. 1 is a perspective view of a defrosting appliance, in accordance with an example embodiment.

The following detailed description is merely illustrative in nature and is not intended to limit the embodiments of the subject matter or the application and uses of such embodiments. As used herein, the words "exemplary" and "example" mean "serving as an example, instance, or illustration." Any implementation described herein as exemplary or an example is not necessarily to be construed as preferred or advantageous over other implementations. Furthermore, there is no intention to be bound by any expressed or implied theory presented in the preceding technical field, background, or the following detailed description.

Embodiments of the inventive subject matter described herein relate to detecting and preventing electrical arcs within systems that can produce high radio frequency (RF) voltages (referred to herein as "RF systems"). Example systems described in detail herein include solid-state defrosting apparatus, however those of skill in the art should understand, based on the description herein, that the arc prevention embodiments may be implemented in any of a variety of RF systems, including but not limited to solid-state defrosting and cooking apparatus, transmitter antenna tuners, plasma generator load matching apparatus, and other RF systems in which electrical arcing is prone to occur between system components.

According to various embodiments, arc detection and prevention is achieved with an arc detection sub-system, which includes non-linear device(s) strategically connected in various locations within an RF system, and more particularly across high voltage stress points in system. The non-linear device(s) desirably have low parasitic capacitance to minimize impact to the system. In addition, in some embodiments, the non-linear device(s) are not directly connected to the system controller, which addresses challenges of detection with high common mode RF voltage detection. Embodiments of the system may protect both the load and the RF system elements.

According to an embodiment, the arc detection sub-system monitors the RF input match, S11, voltage standing wave ratio (VSWR), or current. Changes of S11, VSWR, or current that exceed pre-determined magnitude and/or rate thresholds indicate that the non-linear device has changed state, and that voltages in the system may have values that indicate that an arcing event may occur or is occurring. Once detected, the arc detection sub-system may take actions and/or change conditions to attempt to prevent or stop an arcing condition. Embodiments of the inventive subject matter may be constructed using optimally sized components while not compromising reliability.

Some non-limiting embodiments of systems in which the arc detection and prevention embodiments may be implemented include solid-state defrosting apparatus that may be incorporated into stand-alone appliances or into other systems. As described in greater detail below, embodiments of solid-state defrosting apparatus include both "unbalanced" defrosting apparatus and "balanced" apparatus. For example, exemplary "unbalanced" defrosting systems are realized using a first electrode disposed in a cavity, a single-ended amplifier arrangement (including one or more transistors), a single-ended impedance matching network coupled between an output of the amplifier arrangement and the first electrode, and a measurement and control system that can detect when a defrosting operation has completed. In contrast, exemplary "balanced" defrosting systems are realized using first and second electrodes disposed in a cavity, a single-ended or double-ended amplifier arrangement (including one or more transistors), a double-ended impedance matching network coupled between an output of the amplifier arrangement and the first and second electrodes, and a measurement and control system that can detect when a defrosting operation has completed. In various embodiments, the impedance matching network includes a variable impedance matching network that can be adjusted during the defrosting operation to improve matching between the amplifier arrangement and the cavity. According to various embodiments, and as will be described in more detail later, non-linear devices associated with an arc detection sub-system are placed across components of the single-ended matching network or double-ended matching network of the unbalanced and balanced defrosting systems described herein.

Generally, the term "defrosting" means to elevate the temperature of a frozen load (e.g., a food load or other type of load) to a temperature at which the load is no longer frozen (e.g., a temperature at or near 0 degrees Celsius). As used herein, the term "defrosting" more broadly means a process by which the thermal energy or temperature of a load (e.g., a food load or other type of load) is increased through provision of radio frequency (RF) power to the load. Accordingly, in various embodiments, a "defrosting operation" may be performed on a load with any initial temperature (e.g., any initial temperature above or below 0 degrees Celsius), and the defrosting operation may be ceased at any final temperature that is higher than the initial temperature (e.g., including final temperatures that are above or below 0 degrees Celsius). That said, the "defrosting operations" and "defrosting systems" described herein alternatively may be referred to as "thermal increase operations" and "thermal increase systems." The term "defrosting" should not be construed to limit application of the invention to methods or systems that are only capable of raising the temperature of a frozen load to a temperature at or near 0 degrees Celsius. In one embodiment, a defrosting operation may raise the temperature of a food item to a tempered state at or around −1 degrees Celsius.

Under certain conditions (e.g., extremely arid conditions and/or conditions in which components of a defrosting system with greatly differing electrical potentials are positioned close together), electrical arcing may occur in defrosting systems of the type described herein or in other types of RF systems that can produce high RF voltages. As used here, "arcing" refers to an electrical breakdown of a gas (e.g., air) that produces an ongoing electrical discharge. In the present context, arcing may occur, for example, between adjacent coils of an inductor to which RF power is applied, between such an inductor and an electrode, between such an inductor and a grounded casing or other containment structure, or between other applicable circuit components. Components of a defrosting system may be damaged as a result of arcing that occurs within the defrosting system, and the risk of damage to the defrosting system (e.g., in the form of the melting of electrical conductors and the destruction of insulation) is increased when arcing occurs over an extended period of time.

Conventional arc mitigation methods are generally limited to detecting arcing in a system after the arcing has already occurred in an uncontrolled, unpredictable manner, which can still result in damage to the system and its constituent components. In order to identify potential arcing (e.g., via the identification of an over-voltage condition at along an RF signal transmission path) and prevent arcing from occurring, embodiments of the present invention relate to arc detection sub-systems that may include non-linear devices at locations characterized as being at risk for electrical arcing, such as at various nodes along a transmission path between an RF signal source and a load (e.g., including a defrosting cavity, corresponding electrodes, and a food load), for example. These non-linear devices may include gas discharge tubes, spark gaps, transient-voltage-suppression (TVD) diodes and devices, or any other non-linear device capable of suppressing voltages that exceed a defined breakdown voltage.

Once the voltage across any of the non-linear devices along the transmission path between the RF signal source and the load exceeds the breakdown voltage of the corresponding non-linear device, the non-linear device will begin to conduct, causing a rapid change in the impedance (e.g., resembling a step function) between the RF signal source and the load. This rapid change in impedance is represented by a corresponding rapid change in parameters (e.g., S11 parameters, VSWR, current, etc.) of the RF signal being supplied to the load by the RF signal source, which may be detected by power detection circuitry coupled to one or more outputs of the RF signal source. In response to detecting a rapid rate of change (e.g., exceeding a predefined threshold) of one of these parameters, a controller (e.g., a system controller or microcontroller unit (MCU)) of the system may modify operation of the system in order to alleviate the over-voltage condition before it leads to uncontrolled arcing. For example, this modification may reduce the power of the RF signal generated by the RF signal source (e.g., by 20 percent or to less than 10 percent of the original power value) or may shut down the system (e.g., at least in part by instructing the RF signal source to stop generating the RF signal). In this way, the system may proactively prevent uncontrolled arcing from occurring by detecting and mitigating high voltage (e.g., over-voltage) conditions before they are able to cause uncontrolled and potentially damaging arcing.

FIG. 1 is a perspective view of a defrosting system 100, in accordance with an example embodiment. Defrosting system 100 includes a defrosting cavity 110 (e.g., cavity 260, 560, 1174, FIGS. 2, 5, 11), a control panel 120, one or more RF signal sources (e.g., RF signal source 220, 520, 1120, FIGS. 2, 5, 11), a power supply (e.g., power supply 226, 526, FIGS. 2, 5), a first electrode 170 (e.g., electrode 240, 540, 1170, FIGS. 2, 5, 11), a second electrode 172 (e.g., electrode 550, 1172, FIGS. 5, 11), impedance matching circuitry (e.g., circuits 234, 270, 534, 572, 1160, FIGS. 2, 5, 11), power detection circuitry (e.g., power detection circuitry 230, 530, 1180, FIGS. 2, 5, 11), and a system controller (e.g., system controller 212, 512, 1130, FIGS. 2, 5, 11). The defrosting cavity 110 is defined by interior surfaces of top, bottom, side, and back cavity walls 111, 112, 113, 114, 115 and an interior surface of door 116. With door 116 closed, the defrosting cavity 110 defines an enclosed air cavity. As used herein, the term "air cavity" may mean an enclosed area that contains air or other gasses (e.g., defrosting cavity 110).

According to an "unbalanced" embodiment, the first electrode 170 is arranged proximate to a cavity wall (e.g., top wall 111), the first electrode 170 is electrically isolated from the remaining cavity walls (e.g., walls 112-115 and door 116), and the remaining cavity walls are grounded. In such a configuration, the system may be simplistically modeled as a capacitor, where the first electrode 170 functions as one conductive plate (or electrode), the grounded cavity walls (e.g., walls 112-115) function as a second conductive plate (or electrode), and the air cavity (including any load contained therein) function as a dielectric medium between the first and second conductive plates. Although not shown in FIG. 1, a non-electrically conductive barrier (e.g., barrier 262, FIG. 2) also may be included in the system 100, and the non-conductive barrier may function to electrically and physically isolate the load from the bottom cavity wall 112. Although FIG. 1 shows the first electrode 170 being proximate to the top wall 111, the first electrode 170 alternatively may be proximate to any of the other walls 112-115, as indicated by electrodes 172-175.

According to a "balanced" embodiment, the first electrode 170 is arranged proximate to a first cavity wall (e.g., top wall 111), a second electrode 172 is arranged proximate to an opposite, second cavity wall (e.g., bottom wall 112), and the first and second electrodes 170, 172 are electrically isolated from the remaining cavity walls (e.g., walls 113-115 and door 116). In such a configuration, the system also may be simplistically modeled as a capacitor, where the first electrode 170 functions as one conductive plate (or electrode), the second electrode 172 functions as a second conductive plate (or electrode), and the air cavity (including any load contained therein) function as a dielectric medium between the first and second conductive plates. Although not shown in FIG. 1, a non-electrically conductive barrier (e.g., barrier 562, 1156, FIGS. 5, 11) also may be included in the system 100, and the non-conductive barrier may function to electrically and physically isolate the load from the second electrode 172 and the bottom cavity wall 112. Although FIG. 1 shows the first electrode 170 being proximate to the top wall 111, and the second electrode 172 being proximate to the bottom wall 112, the first and second electrodes 170, 172 alternatively may be proximate to other opposite walls (e.g., the first electrode may be electrode 173 proximate to wall 113, and the second electrode may be electrode 174 proximate to wall 114).

According to an embodiment, during operation of the defrosting system 100, a user (not illustrated) may place one or more loads (e.g., food and/or liquids) into the defrosting cavity 110, and optionally may provide inputs via the control panel 120 that specify characteristics of the load(s). For example, the specified characteristics may include an approximate weight of the load. In addition, the specified load characteristics may indicate the material(s) from which the load is formed (e.g., meat, bread, liquid). In alternate embodiments, the load characteristics may be obtained in some other way, such as by scanning a barcode on the load packaging or receiving a radio frequency identification (RFID) signal from an RFID tag on or embedded within the load. Either way, as will be described in more detail later, information regarding such load characteristics enables the system controller (e.g., system controller 212, 512, 1130, FIGS. 2, 5, 11) to establish an initial state for the impedance matching network of the system at the beginning of the defrosting operation, where the initial state may be relatively close to an optimal state that enables maximum RF power transfer into the load. Alternatively, load characteristics may not be entered or received prior to commencement of a defrosting operation, and the system controller may establish a default initial state for the impedance matching network.

To begin the defrosting operation, the user may provide an input via the control panel 120. In response, the system controller causes the RF signal source(s) (e.g., RF signal source 220, 520, 1120, FIGS. 2, 5, 11) to supply an RF signal to the first electrode 170 in an unbalanced embodiment, or to both the first and second electrodes 170, 172 in a balanced embodiment, and the electrode(s) responsively radiate electromagnetic energy into the defrosting cavity 110. The electromagnetic energy increases the thermal energy of the load (i.e., the electromagnetic energy causes the load to warm up).

During the defrosting operation, the impedance of the load (and thus the total input impedance of the cavity 110 plus load) changes as the thermal energy of the load increases. The impedance changes alter the absorption of RF energy into the load, and thus alter the magnitude of reflected power. According to an embodiment, power detection circuitry (e.g., power detection circuitry 230, 530, 1180, FIGS. 2, 5, 11) continuously or periodically measures the reflected power along a transmission path (e.g., transmission path 228, 528, 1148, FIGS. 2, 5, 11) between the RF signal source (e.g., RF signal source 220, 520, 1120, FIGS. 2, 5, 11) and the electrode(s) 170, 172. Based on these measurements, the system controller (e.g., system controller 212, 512, 1130, FIGS. 2, 5, 11) may detect completion of the defrosting operation, as will be described in detail below. According to a further embodiment, the impedance matching network is variable, and based on the reflected power measurements (or both the forward and reflected power measurements, S11 parameter, and/or VSWR), the system controller may alter the state of the impedance matching network during the defrosting operation to increase the absorption of RF power by the load.

The defrosting system 100 of FIG. 1 is embodied as a counter-top type of appliance. In a further embodiment, the defrosting system 100 also may include components and functionality for performing microwave cooking operations. Alternatively, components of a defrosting system may be incorporated into other types of systems or appliances. For example, the defrosting system may be incorporated into a refrigerator/freezer appliance or into systems or appliances having other configurations, as well. Accordingly, the above-described implementations of defrosting systems in a stand-alone appliance are not meant to limit use of the embodiments only to those types of systems.

Figure 2:
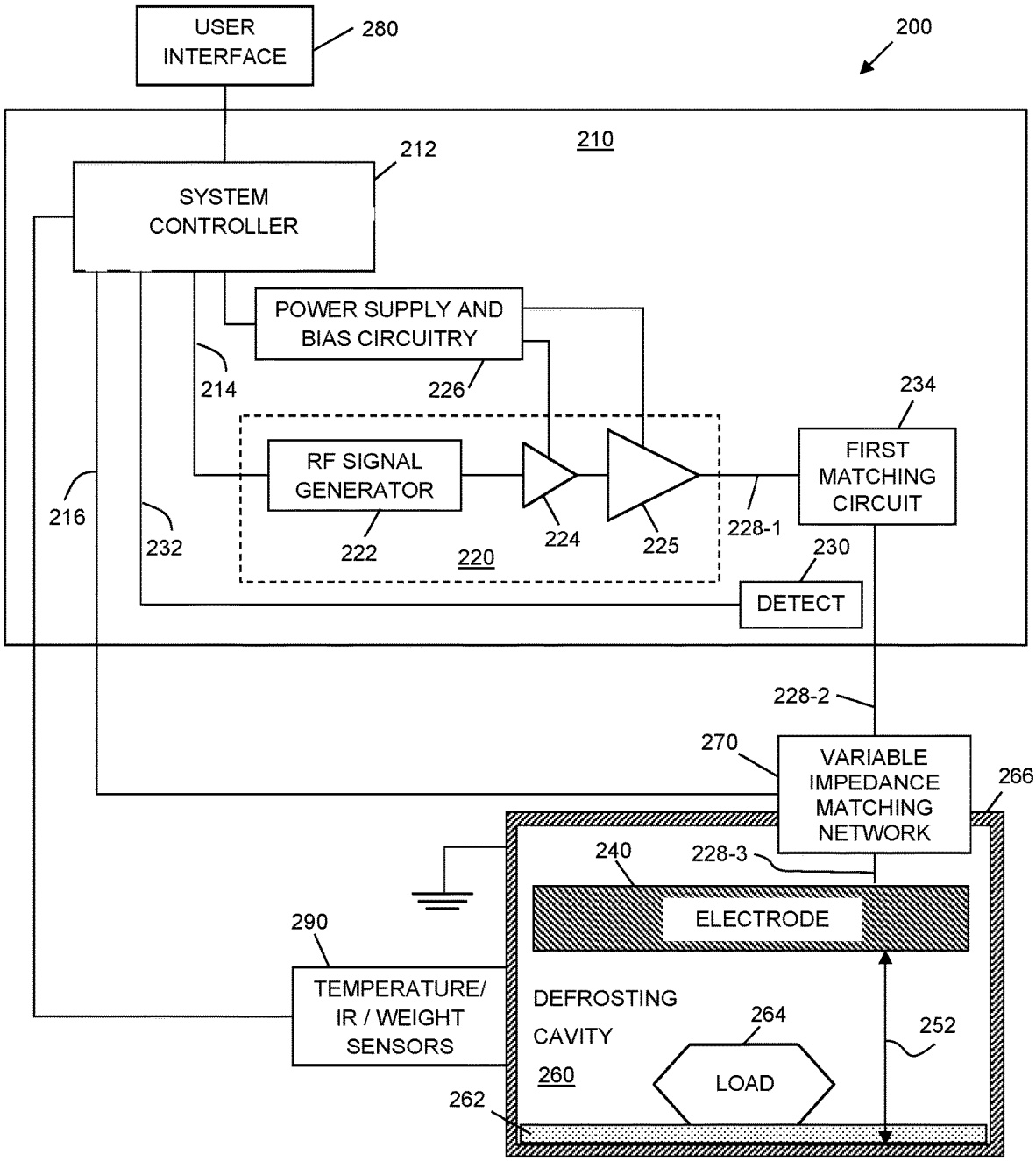
FIG. 2 is a simplified block diagram of an unbalanced defrosting apparatus, in accordance with an example embodiment.

FIG. 2 is a simplified block diagram of an unbalanced defrosting system 200 (e.g., defrosting system 100, FIG. 1), in accordance with an example embodiment. Defrosting system 200 includes RF subsystem 210, defrosting cavity 260, user interface 280, system controller 212, RF signal source 220, power supply and bias circuitry 226, variable impedance matching network 270, electrode 240, containment structure 266, and power detection circuitry 230, in an embodiment. In addition, in other embodiments, defrosting system 200 may include temperature sensor(s), infrared (IR) sensor(s), and/or weight sensor(s) 290, although some or all of these sensor components may be excluded. It should be understood that FIG. 2 is a simplified representation of a defrosting system 200 for purposes of explanation and ease of description, and that practical embodiments may include other devices and components to provide additional functions and features, and/or the defrosting system 200 may be part of a larger electrical system.

User interface 280 may correspond to a control panel (e.g., control panel 120, FIG. 1), for example, which enables a user to provide inputs to the system regarding parameters for a defrosting operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting operation (e.g., a countdown timer, visible indicia indicating progress or completion of the defrosting operation, and/or audible tones indicating completion of the defrosting operation) and other information.

Some embodiments of defrosting system 200 may include temperature sensor(s), IR sensor(s), and/or weight sensor(s) 290. The temperature sensor(s) and/or IR sensor(s) may be positioned in locations that enable the temperature of the load 264 to be sensed during the defrosting operation. When provided to the system controller 212, the temperature information enables the system controller 212 to alter the power of the RF signal supplied by the RF signal source 220 (e.g., by controlling the bias and/or supply voltages provided by the power supply and bias circuitry 226), to adjust the state of the variable impedance matching network 270, and/or to determine when the defrosting operation should be terminated. The weight sensor(s) are positioned under the load 264, and are configured to provide an estimate of the weight of the load 264 to the system controller 212. The system controller 212 may use this information, for example, to determine a desired power level for the RF signal supplied by the RF signal source 220, to determine an initial setting for the variable impedance matching network 270, and/or to determine an approximate duration for the defrosting operation.

The RF subsystem 210 includes a system controller 212, an RF signal source 220, first impedance matching circuit 234 (herein "first matching circuit"), power supply and bias circuitry 226, and power detection circuitry 230, in an embodiment. System controller 212 may include one or more general purpose or special purpose processors (e.g., a microprocessor, microcontroller, Application Specific Integrated Circuit (ASIC), and so on), volatile and/or non-volatile memory (e.g., Random Access Memory (RAM), Read Only Memory (ROM), flash, various registers, and so on), one or more communication busses, and other components. According to an embodiment, system controller 212 is coupled to user interface 280, RF signal source 220, variable impedance matching network 270, power detection circuitry 230, and sensors 290 (if included). System controller 212 is configured to receive signals indicating user inputs received via user interface 280, and to receive signals indicating RF signal reflected power (and possibly RF signal forward power) from power detection circuitry 230. Responsive to the received signals and measurements, and as will be described in more detail later, system controller 212 provides control signals to the power supply and bias circuitry 226 and to the RF signal generator 222 of the RF signal source 220. In addition, system controller 212 provides control signals to the variable impedance matching network 270, which cause the network 270 to change its state or configuration.

Defrosting cavity 260 includes a capacitive defrosting arrangement with first and second parallel plate electrodes that are separated by an air cavity within which a load 264 to be defrosted may be placed. For example, a first electrode 240 may be positioned above the air cavity, and a second electrode may be provided by a portion of a containment structure 266. More specifically, the containment structure 266 may include bottom, top, and side walls, the interior surfaces of which define the cavity 260 (e.g., cavity 110, FIG. 1). According to an embodiment, the cavity 260 may be sealed (e.g., with a door 116, FIG. 1) to contain the electromagnetic energy that is introduced into the cavity 260 during a defrosting operation. The system 200 may include one or more interlock mechanisms that ensure that the seal is intact during a defrosting operation. If one or more of the interlock mechanisms indicates that the seal is breached, the system controller 212 may cease the defrosting operation. According to an embodiment, the containment structure 266 is at least partially formed from conductive material, and the conductive portion(s) of the containment structure may be grounded. Alternatively, at least the portion of the containment structure 266 that corresponds to the bottom surface of the cavity 260 may be formed from conductive material and grounded. Either way, the containment structure 266 (or at least the portion of the containment structure 266 that is parallel with the first electrode 240) functions as a second electrode of the capacitive defrosting arrangement. To avoid direct contact between the load 264 and the grounded bottom surface of the cavity 260, a non-conductive barrier 262 may be positioned over the bottom surface of the cavity 260.

Essentially, defrosting cavity 260 includes a capacitive defrosting arrangement with first and second parallel plate electrodes 240, 266 that are separated by an air cavity within which a load 264 to be defrosted may be placed. The first electrode 240 is positioned within containment structure 266 to define a distance 252 between the electrode 240 and an opposed surface of the containment structure 266 (e.g., the bottom surface, which functions as a second electrode), where the distance 252 renders the cavity 260 a sub-resonant cavity, in an embodiment.

In various embodiments, the distance 252 is in a range of about 0.10 meters to about 1.0 meter, although the distance may be smaller or larger, as well. According to an embodiment, distance 252 is less than one wavelength of the RF signal produced by the RF subsystem 210. In other words, as mentioned above, the cavity 260 is a sub-resonant cavity. In some embodiments, the distance 252 is less than about half of one wavelength of the RF signal. In other embodiments, the distance 252 is less than about one quarter of one wavelength of the RF signal. In still other embodiments, the distance 252 is less than about one eighth of one wavelength of the RF signal. In still other embodiments, the distance 252 is less than about one 50th of one wavelength of the RF signal. In still other embodiments, the distance 252 is less than about one 100th of one wavelength of the RF signal.

In general, a system 200 designed for lower operational frequencies (e.g., frequencies between 10 MHz and 100 MHz) may be designed to have a distance 252 that is a smaller fraction of one wavelength. For example, when system 200 is designed to produce an RF signal with an operational frequency of about 10 MHz (corresponding to a wavelength of about 30 meters), and distance 252 is selected to be about 0.5 meters, the distance 252 is about one 60th of one wavelength of the RF signal. Conversely, when system 200 is designed for an operational frequency of about 300 MHz (corresponding to a wavelength of about 1 meter), and distance 252 is selected to be about 0.5 meters, the distance 252 is about one half of one wavelength of the RF signal.

With the operational frequency and the distance 252 between electrode 240 and containment structure 266 being selected to define a sub-resonant interior cavity 260, the first electrode 240 and the containment structure 266 are capacitively coupled. More specifically, the first electrode 240 may be analogized to a first plate of a capacitor, the containment structure 266 may be analogized to a second plate of a capacitor, and the load 264, barrier 262, and air within the cavity 260 may be analogized to a capacitor dielectric. Accordingly, the first electrode 240 alternatively may be referred to herein as an "anode," and the containment structure 266 may alternatively be referred to herein as a "cathode."

Essentially, the voltage across the first electrode 240 and the containment structure 266 heats the load 264 within the cavity 260. According to various embodiments, the RF subsystem 210 is configured to generate the RF signal to produce voltages between the electrode 240 and the containment structure 266 in a range of about 90 volts to about 3000 volts, in one embodiment, or in a range of about 3000 volts to about 10,000 volts, in another embodiment, although the system may be configured to produce lower or higher voltages between the electrode 240 and the containment structure 266, as well.

Figure 5:
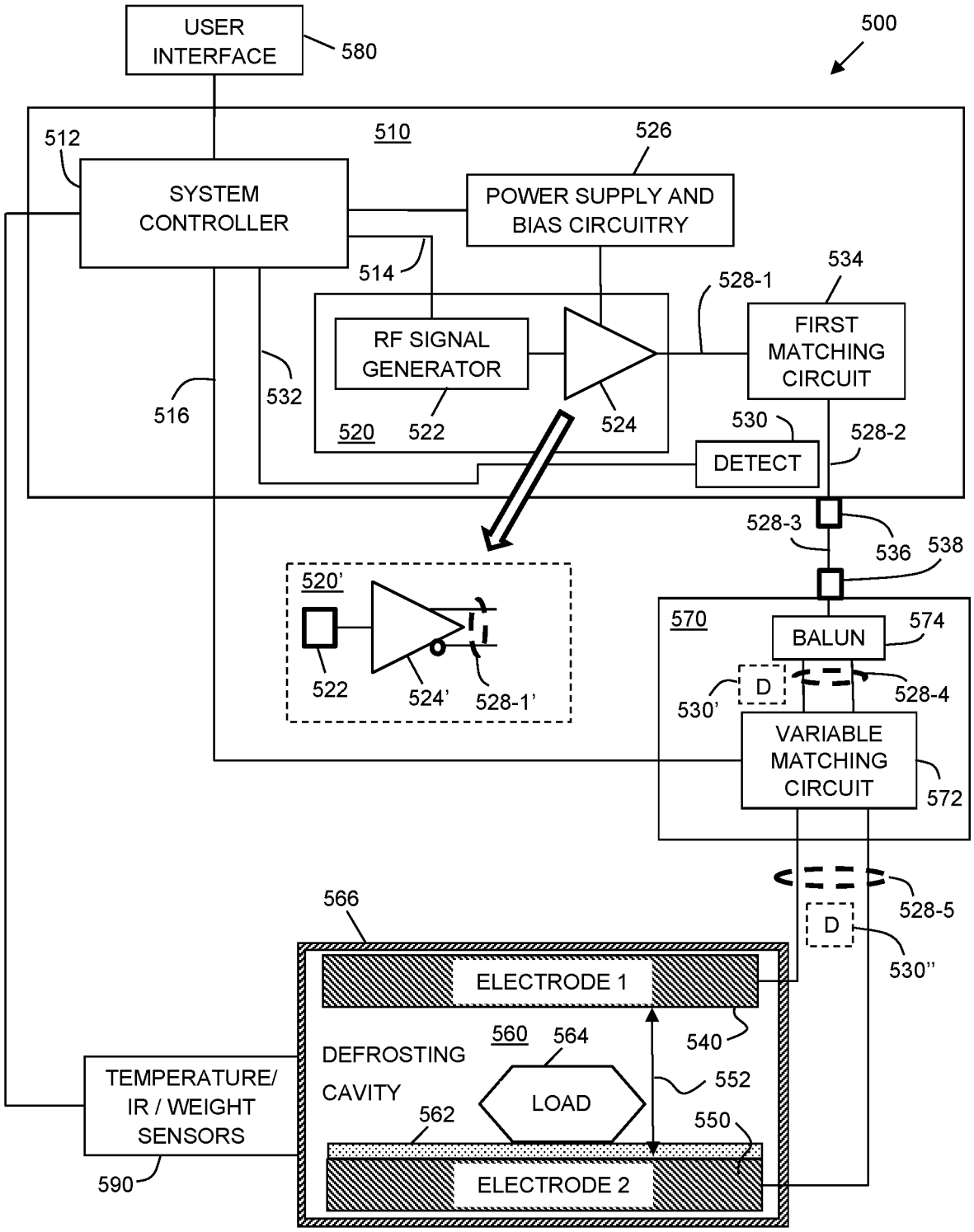
FIG. 5 is a simplified block diagram of a balanced defrosting apparatus, in accordance with another example embodiment.

The first electrode 240 is electrically coupled to the RF signal source 220 through a first matching circuit 234, a variable impedance matching network 270, and a conductive transmission path, in an embodiment. The first matching circuit 234 is configured to perform an impedance transformation from an impedance of the RF signal source 220 (e.g., less than about 10 ohms) to an intermediate impedance (e.g., 50 ohms, 75 ohms, or some other value). According to an embodiment, the conductive transmission path includes a plurality of conductors 228-1, 228-2, and 228-3 connected in series, and referred to collectively as transmission path 228. According to an embodiment, the conductive transmission path 228 is an "unbalanced" path, which is configured to carry an unbalanced RF signal (i.e., a single RF signal referenced against ground). In some embodiments, one or more connectors (not shown, but each having male and female connector portions) may be electrically coupled along the transmission path 228, and the portion of the transmission path 228 between the connectors may comprise a coaxial cable or other suitable connector. Such a connection is shown in FIG. 5 and described later (e.g., including connectors 536, 538 and a conductor 528-3 such as a coaxial cable between the connectors 536, 538).

As will be described in more detail later, the variable impedance matching circuit 270 is configured to perform an impedance transformation from the above-mentioned intermediate impedance to an input impedance of defrosting cavity 220 as modified by the load 264 (e.g., on the order of hundreds or thousands of ohms, such as about 1000 ohms to about 4000 ohms or more). In an embodiment, the variable impedance matching network 270 includes a network of passive components (e.g., inductors, capacitors, resistors).

Figure 3:
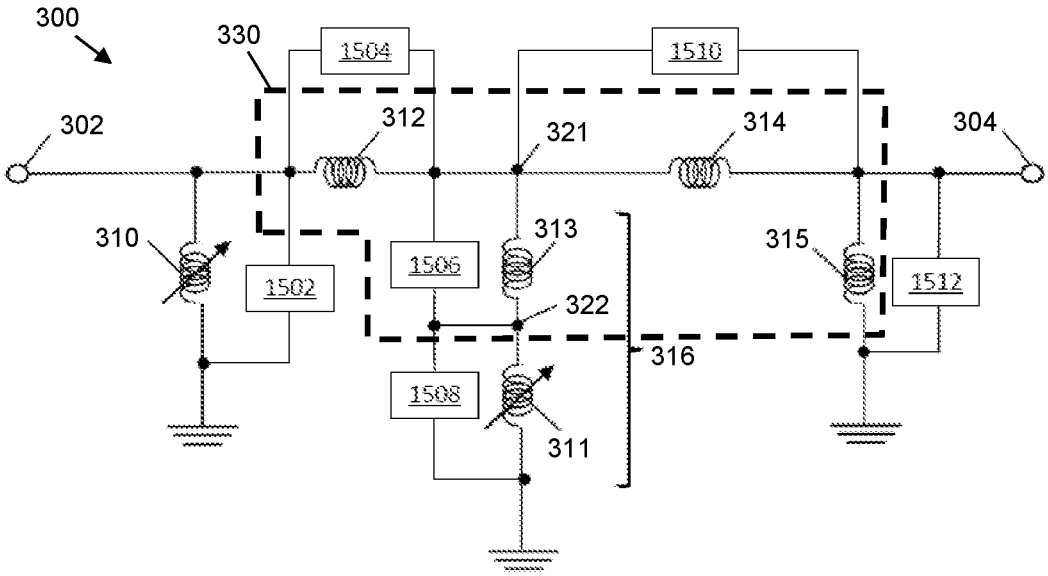
FIG. 3 is a schematic diagram of a single-ended variable inductance matching network, in accordance with an example embodiment.
Figure 4:
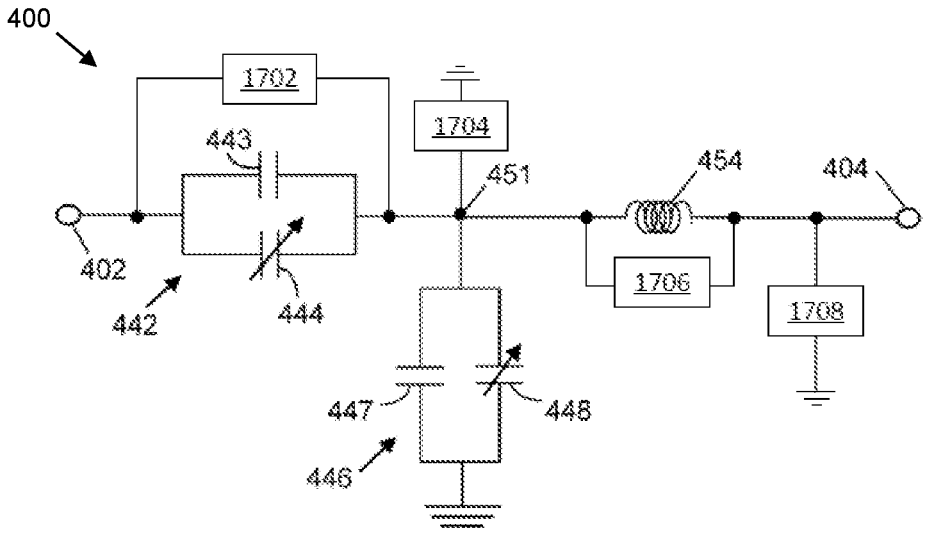
FIG. 4 is a schematic diagram of a single-ended variable capacitive matching network, in accordance with an example embodiment.

According to one more specific embodiment, the variable impedance matching network 270 includes a plurality of fixed-value lumped inductors (e.g., inductors 312-314, 454. FIGS. 3, 4) that are positioned within the cavity 260 and which are electrically coupled to the first electrode 240. In addition, the variable impedance matching network 270 includes a plurality of variable inductance networks (e.g., networks 310, 311, 315, FIG. 3), which may be located inside or outside of the cavity 260. According to another more specific embodiment, the variable impedance matching network 270 includes a plurality of variable capacitance networks (e.g., networks 442, 446, FIG. 4), which may be located inside or outside of the cavity 260. The inductance or capacitance value provided by each of the variable inductance or capacitance networks is established using control signals from the system controller 212, as will be described in more detail later. In any event, by changing the state of the variable impedance matching network 270 over the course of a defrosting operation to dynamically match the ever-changing cavity plus load impedance, the amount of RF power that is absorbed by the load 264 may be maintained at a high level despite variations in the load impedance during the defrosting operation.

In some embodiments, non-linear devices (e.g., gas discharge tubes, spark gaps, transient-voltage-suppression (TVS) diodes, etc.) may be coupled in parallel across any or all of the fixed and variable components (e.g., individual inductors, individual capacitors, lumped inductors, lumped capacitors, variable capacitor networks, variable inductor networks, etc.) of the variable impedance matching network 270. Each of these non-linear devices may have an individual breakdown voltage, such that, when a voltage across a given non-linear device (e.g., and therefore a voltage across the fixed or variable component coupled in parallel with that non-linear device) exceeds the individual breakdown voltage for that non-linear device, the given non-linear device begins to conduct, rapidly changing the impedance of the variable impedance matching circuit 270. The non-linear device coupled to a particular component of the variable impedance matching network 270 may have a breakdown voltage that is less than (e.g., a fraction of) a maximum operating voltage of the component, above which arcing may occur at the component or the component may be damaged. For example, the component may be a capacitor that is rated for a maximum operating voltage of 1000 V (or some other maximum operating voltage), and the non-linear device coupled to the capacitor may have a breakdown voltage of 900 V (or some other breakdown voltage that is less than the operating voltage of the device across which the non-linear device is connected), so that the non-linear device will begin to conduct and change the impedance of the variable impedance matching network 270 before the maximum operating voltage of the capacitor is reached. The system controller 212 may detect the change in impedance of the variable impedance matching network 270 caused by the breakdown voltage of the non-linear device being exceeded (e.g., based on the rate of change of an S11 parameter and/or VSWR measured at the RF signal source 220), and may cause the RF signal supplied by the RF signal source 220 to be reduced in power or stopped so that the maximum operating voltage of the capacitor is not exceeded.

According to an embodiment, RF signal source 220 includes an RF signal generator 222 and a power amplifier (e.g., including one or more power amplifier stages 224, 225). In response to control signals provided by system controller 212 over connection 214, RF signal generator 222 is configured to produce an oscillating electrical signal having a frequency in the ISM (industrial, scientific, and medical) band, although the system could be modified to support operations in other frequency bands, as well. The RF signal generator 222 may be controlled to produce oscillating signals of different power levels and/or different frequencies, in various embodiments. For example, the RF signal generator 222 may produce a signal that oscillates in the VHF (very high frequency) range (i.e., in a range between about 30.0 megahertz (MHz) and about 300 MHz), and/or in a range of about 10.0 MHz to about 100 MHz, and/or from about 100 MHz to about 3.0 gigahertz (GHz). Some desirable frequencies may be, for example, 13.56 MHz (+/−5 percent), 27.125 MHz (+/−5 percent), 40.68 MHz (+/−5 percent), and 2.45 GHz (+/−5 percent). In one particular embodiment, for example, the RF signal generator 222 may produce a signal that oscillates in a range of about 40.66 MHz to about 40.70 MHz and at a power level in a range of about 10 decibel-milliwatts (dBm) to about 15 dBm. Alternatively, the frequency of oscillation and/or the power level may be lower or higher.

In the embodiment of FIG. 2, the power amplifier includes a driver amplifier stage 224 and a final amplifier stage 225. The power amplifier is configured to receive the oscillating signal from the RF signal generator 222, and to amplify the signal to produce a significantly higher-power signal at an output of the power amplifier. For example, the output signal may have a power level in a range of about 100 watts to about 400 watts or more. The gain applied by the power amplifier may be controlled using gate bias voltages and/or drain supply voltages provided by the power supply and bias circuitry 226 to each amplifier stage 224, 225. More specifically, power supply and bias circuitry 226 provides bias and supply voltages to each RF amplifier stage 224, 225 in accordance with control signals received from system controller 212.

In an embodiment, each amplifier stage 224, 225 is implemented as a power transistor, such as a field effect transistor (FET), having an input terminal (e.g., a gate or control terminal) and two current carrying terminals (e.g., source and drain terminals). Impedance matching circuits (not illustrated) may be coupled to the input (e.g., gate) of the driver amplifier stage 224, between the driver and final amplifier stages 225, and/or to the output (e.g., drain terminal) of the final amplifier stage 225, in various embodiments. In an embodiment, each transistor of the amplifier stages 224, 225 includes a laterally diffused metal oxide semiconductor FET (LDMOSFET) transistor. However, it should be noted that the transistors are not intended to be limited to any particular semiconductor technology, and in other embodiments, each transistor may be realized as a gallium nitride (GaN) transistor, another type of MOSFET transistor, a bipolar junction transistor (BJT), or a transistor utilizing another semiconductor technology.

In FIG. 2, the power amplifier arrangement is depicted to include two amplifier stages 224, 225 coupled in a particular manner to other circuit components. In other embodiments, the power amplifier arrangement may include other amplifier topologies and/or the amplifier arrangement may include only one amplifier stage (e.g., as shown in the embodiment of amplifier 524, FIG. 5), or more than two amplifier stages. For example, the power amplifier arrangement may include various embodiments of a single-ended amplifier, a Doherty amplifier, a Switch Mode Power Amplifier (SMPA), or another type of amplifier.

Defrosting cavity 260 and any load 264 (e.g., food, liquids, and so on) positioned in the defrosting cavity 260 present a cumulative load for the electromagnetic energy (or RF power) that is radiated into the cavity 260 by the first electrode 240. More specifically, the cavity 260 and the load 264 present an impedance to the system, referred to herein as a "cavity plus load impedance." The cavity plus load impedance changes during a defrosting operation as the temperature of the load 264 increases. The cavity plus load impedance has a direct effect on the magnitude of reflected signal power along the conductive transmission path 228 between the RF signal source 220 and electrodes 240. In most cases, it is desirable to maximize the magnitude of transferred signal power into the cavity 260, and/or to minimize the reflected-to-forward signal power ratio along the conductive transmission path 228.

In order to at least partially match the output impedance of the RF signal generator 220 to the cavity plus load impedance, a first matching circuit 234 is electrically coupled along the transmission path 228, in an embodiment. The first matching circuit 234 may have any of a variety of configurations. According to an embodiment, the first matching circuit 234 includes fixed components (i.e., components with non-variable component values), although the first matching circuit 234 may include one or more variable components, in other embodiments. For example, the first matching circuit 234 may include any one or more circuits selected from an inductance/capacitance (LC) network, a series inductance network, a shunt inductance network, or a combination of bandpass, high-pass and low-pass circuits, in various embodiments. Essentially, the fixed matching circuit 234 is configured to raise the impedance to an intermediate level between the output impedance of the RF signal generator 220 and the cavity plus load impedance.

According to an embodiment, power detection circuitry 230 is coupled along the transmission path 228 between the output of the RF signal source 220 and the electrode 240. In a specific embodiment, the power detection circuitry 230 forms a portion of the RF subsystem 210, and is coupled to the conductor 228-2 between the output of the first matching circuit 234 and the input to the variable impedance matching network 270, in an embodiment. In alternate embodiments, the power detection circuitry 230 may be coupled to the portion 228-1 of the transmission path 228 between the output of the RF signal source 220 and the input to the first matching circuit 234, or to the portion 228-3 of the transmission path 228 between the output of the variable impedance matching network 270 and the first electrode 240.

Wherever it is coupled, power detection circuitry 230 is configured to monitor, measure, or otherwise detect the power of the reflected signals traveling along the transmission path 228 between the RF signal source 220 and electrode 240 (i.e., reflected RF signals traveling in a direction from electrode 240 toward RF signal source 220). In some embodiments, power detection circuitry 230 also is configured to detect the power of the forward signals traveling along the transmission path 228 between the RF signal source 220 and the electrode 240 (i.e., forward RF signals traveling in a direction from RF signal source 220 toward electrode 240). Over connection 232, power detection circuitry 230 supplies signals to system controller 212 conveying the magnitudes of the reflected signal power (and the forward signal power, in some embodiments) to system controller 212. In embodiments in which both the forward and reflected signal power magnitudes are conveyed, system controller 212 may calculate a reflected-to-forward signal power ratio, or the S11 parameter, or a VSWR value. As will be described in more detail below, when the reflected signal power magnitude exceeds a reflected signal power threshold, or when the reflected-to-forward signal power ratio exceeds an S11 parameter threshold, or when a VSWR value exceeds a VSWR threshold, this indicates that the system 200 is not adequately matched to the cavity plus load impedance, and that energy absorption by the load 264 within the cavity 260 may be sub-optimal. In such a situation, system controller 212 orchestrates a process of altering the state of the variable matching network 270 to drive the reflected signal power or the S11 parameter or the VSWR value toward or below a desired level (e.g., below the reflected signal power threshold, and/or the reflected-to-forward signal power ratio threshold, and/or the S11 parameter threshold, and/or the VSWR threshold), thus re-establishing an acceptable match and facilitating more optimal energy absorption by the load 264.

In some embodiments, the system controller 212 and power detection circuitry 230 may form portions of the arc detection sub-system, and the system controller 212 and power detection circuitry 230 may detect rapid changes in impedance (e.g., as a rapid change in the S11 parameter, VSWR, and/or current derived by the system controller 212 from measurements made by the power detection circuitry 230) associated with the breakdown voltage of a non-linear device (e.g., one or more of devices 1502, 1504, 1506, 1508, 1510, 1512, 1702, 1704, 1706, 1708, FIGS. 3, 4) in the variable impedance matching circuit 270 being exceeded. For example, if the system controller 212 determines that the rate of change of the S11 parameter and/or VSWR value exceeds a predetermined threshold value, the system 200 may modify component values of the variable matching circuit 270 to attempt to correct the arcing condition or, alternatively, may reduce the power of or discontinue the supply of the RF signal by the RF signal generator 222 in order to prevent uncontrolled electrical arcing.

For example, the system controller 212 may provide control signals over control path 216 to the variable matching circuit 270, which cause the variable matching circuit 270 to vary inductive, capacitive, and/or resistive values of one or more components within the circuit, thus adjusting the impedance transformation provided by the circuit 270. Adjustment of the configuration of the variable matching circuit 270 desirably decreases the magnitude of reflected signal power, which corresponds to decreasing the magnitude of the S11 parameter and/or VSWR, and increasing the power absorbed by the load 264.

As discussed above, the variable impedance matching network 270 is used to match the cavity plus load impedance of the defrosting cavity 260 plus load 264 to maximize, to the extent possible, the RF power transfer into the load 264. The initial impedance of the defrosting cavity 260 and the load 264 may not be known with accuracy at the beginning of a defrosting operation. Further, the impedance of the load 264 changes during a defrosting operation as the load 264 warms up. According to an embodiment, the system controller 212 may provide control signals to the variable impedance matching network 270, which cause modifications to the state of the variable impedance matching network 270. This enables the system controller 212 to establish an initial state of the variable impedance matching network 270 at the beginning of the defrosting operation that has a relatively low reflected to forward power ratio, and thus a relatively high absorption of the RF power by the load 264. In addition, this enables the system controller 212 to modify the state of the variable impedance matching network 270 so that an adequate match may be maintained throughout the defrosting operation, despite changes in the impedance of the load 264.

Non-limiting examples of configurations for the variable matching network 270 are shown in FIGS. 3 and 4. For example, the network 270 may include any one or more circuits selected from an inductance/capacitance (LC) network, an inductance-only network, a capacitance-only network, or a combination of bandpass, high-pass and low-pass circuits, in various embodiments. In an embodiment, the variable matching network 270 includes a single-ended network (e.g., network 300, 400, FIG. 3, 4). The inductance, capacitance, and/or resistance values provided by the variable matching network 270, which in turn affect the impedance transformation provided by the network 270, are established using control signals from the system controller 212, as will be described in more detail later. In any event, by changing the state of the variable matching network 270 over the course of a defrosting operation to dynamically match the ever-changing impedance of the cavity 260 plus the load 264 within the cavity 260, the system efficiency may be maintained at a high level throughout the defrosting operation.

The variable matching network 270 may have any of a wide variety of circuit configurations, and non-limiting examples of such configurations are shown in FIGS. 3 and 4. According to an embodiment, as exemplified in FIG. 3, the variable impedance matching network 270 may include a single-ended network of passive components, and more specifically a network of fixed-value inductors (e.g., lumped inductive components) and variable inductors (or variable inductance networks). According to another embodiment, as exemplified in FIG. 4, the variable impedance matching network 270 may include a single-ended network of passive components, and more specifically a network of variable capacitors (or variable capacitance networks). As used herein, the term "inductor" means a discrete inductor or a set of inductive components that are electrically coupled together without intervening components of other types (e.g., resistors or capacitors). Similarly, the term "capacitor" means a discrete capacitor or a set of capacitive components that are electrically coupled together without intervening components of other types (e.g., resistors or inductors).

Referring first to the variable-inductance impedance matching network embodiment, FIG. 3 is a schematic diagram of a single-ended variable impedance matching network 300 (e.g., variable impedance matching network 270, FIG. 2), in accordance with an example embodiment. As will be explained in more detail below, the variable impedance matching network 270 essentially has two portions: one portion to match the RF signal source (or the final stage power amplifier), and another portion to match the cavity plus load.

Variable impedance matching network 300 includes an input node 302, an output node 304, first and second variable inductance networks 310, 311, and a plurality of fixed-value inductors 312-315, according to an embodiment. When incorporated into a defrosting system (e.g., system 200, FIG. 2), the input node 302 is electrically coupled to an output of the RF signal source (e.g., RF signal source 220, FIG. 2), and the output node 304 is electrically coupled to an electrode (e.g., first electrode 240, FIG. 2) within the defrosting cavity (e.g., defrosting cavity 260, FIG. 2).

Between the input and output nodes 302, 304, the variable impedance matching network 300 includes first and second, series coupled lumped inductors 312, 314, in an embodiment. The first and second lumped inductors 312, 314 are relatively large in both size and inductance value, in an embodiment, as they may be designed for relatively low frequency (e.g., about 40.66 MHz to about 40.70 MHz) and high power (e.g., about 50 watts (W) to about 500 W) operation. For example, inductors 312, 314 may have values in a range of about 200 nanohenries (nH) to about 600 nH, although their values may be lower and/or higher, in other embodiments.

The first variable inductance network 310 is a first shunt inductive network that is coupled between the input node 302 and a ground reference terminal (e.g., the grounded containment structure 266, FIG. 2). According to an embodiment, the first variable inductance network 310 is configurable to match the impedance of the RF signal source (e.g., RF signal source 220, FIG. 2) as modified by the first matching circuit (e.g., circuit 234, FIG. 2), or more particularly to match the impedance of the final stage power amplifier (e.g., amplifier 225, FIG. 2) as modified by the first matching circuit (e.g., circuit 234, FIG. 2). Accordingly, the first variable inductance network 310 may be referred to as the "RF signal source matching portion" of the variable impedance matching network 300. According to an embodiment, the first variable inductance network 310 includes a network of inductive components that may be selectively coupled together to provide inductances in a range of about 10 nH to about 400 nH, although the range may extend to lower or higher inductance values, as well.

In contrast, the "cavity matching portion" of the variable impedance matching network 300 is provided by a second shunt inductive network 316 that is coupled between a node 322 between the first and second lumped inductors 312, 314 and the ground reference terminal. According to an embodiment, the second shunt inductive network 316 includes a third lumped inductor 313 and a second variable inductance network 311 coupled in series, with an intermediate node 322 between the third lumped inductor 313 and the second variable inductance network 311. Because the state of the second variable inductance network 311 may be changed to provide multiple inductance values, the second shunt inductive network 316 is configurable to optimally match the impedance of the cavity plus load (e.g., cavity 260 plus load 264, FIG. 2). For example, inductor 313 may have a value in a range of about 400 nH to about 800 nH, although its value may be lower and/or higher, in other embodiments. According to an embodiment, the second variable inductance network 311 includes a network of inductive components that may be selectively coupled together to provide inductances in a range of about 50 nH to about 800 nH, although the range may extend to lower or higher inductance values, as well.

Finally, the variable impedance matching network 300 includes a fourth lumped inductor 315 coupled between the output node 304 and the ground reference terminal. For example, inductor 315 may have a value in a range of about 400 nH to about 800 nH, although its value may be lower and/or higher, in other embodiments.

According to an embodiment, portions of an arc detection sub-system are incorporated in the network 300. More specifically, non-linear devices 1502, 1504, 1506, 1508, 1510, and 1512 (e.g., gas discharge tubes, spark gaps, and/or TVS diodes) have been added so that a rapid impedance change is triggered whenever the voltage across one of the non-linear devices 1502, 1504, 1506, 1508, 1510, and 1512 exceeds a breakdown voltage of that non-linear device.

The non-linear device 1502 may be coupled in parallel with the variable inductance network 310. The non-linear device 1504 may be coupled in parallel with the inductance 312. The non-linear device 1506 may be coupled in parallel with the inductance 313. The non-linear device 1508 may be coupled in parallel with the variable inductance network 311. The non-linear device 1510 may be coupled in parallel with the inductance 314. The non-linear device 1512 may be coupled in parallel with the inductance 315. The breakdown voltage of a given non-linear device of the non-linear devices 1502, 1504, 1506, 1508, 1510, and 1512 may be less than (e.g., by a defined percentage, such as 10% less than) a voltage at which arcing is expected to occur at the circuit component parallel to that non-linear device. In this way, the non-linear device will transition from being insulating to being conductive before electrical arcing can occur at its parallel circuit component, causing a detectable change in the impedance of the circuit 300. For example, if the inductance 312 is expected to experience electrical arcing at 1000 V, the non-linear device 1504 may have a breakdown voltage of 900 V. The voltage rating of readily available gas discharge devices ranges from less than 50 V to over 8000 V. The voltage is chosen to provide some margin to the maximum voltage of the protected component or, if connected between component to ground, the voltage that could cause an arc to ground. These voltages, and consequently the non-linear device rating, are determined as part of the system design through simulation or testing.

The set 330 of lumped inductors 312-315 may form a portion of a module that is at least partially physically located within the cavity (e.g., cavity 260, FIG. 2), or at least within the confines of the containment structure (e.g., containment structure 266, FIG. 2). This enables the radiation produced by the lumped inductors 312-315 to be safely contained within the system, rather than being radiated out into the surrounding environment. In contrast, the variable inductance networks 310, 311 may or may not be contained within the cavity or the containment structure, in various embodiments.

According to an embodiment, the variable impedance matching network 300 embodiment of FIG. 3 includes "only inductors" to provide a match for the input impedance of the defrosting cavity 260 plus load 264. Thus, the network 300 may be considered an "inductor-only" matching network. As used herein, the phrases "only inductors" or "inductor-only" when describing the components of the variable impedance matching network means that the network does not include discrete resistors with significant resistance values or discrete capacitors with significant capacitance values. In some cases, conductive transmission lines between components of the matching network may have minimal resistances, and/or minimal parasitic capacitances may be present within the network. Such minimal resistances and/or minimal parasitic capacitances are not to be construed as converting embodiments of the "inductor-only" network into a matching network that also includes resistors and/or capacitors. Those of skill in the art would understand, however, that other embodiments of variable impedance matching networks may include differently configured inductor-only matching networks, and matching networks that include combinations of discrete inductors, discrete capacitors, and/or discrete resistors.

FIG. 4 is a schematic diagram of a single-ended variable capacitive matching network 400 (e.g., variable impedance matching network 270, FIG. 2), which may be implemented instead of the variable-inductance impedance matching network 300 (FIG. 3), in accordance with an example embodiment. Variable impedance matching network 400 includes an input node 402, an output node 404, first and second variable capacitance networks 442, 446, and at least one inductor 454, according to an embodiment. When incorporated into a defrosting system (e.g., system 200, FIG. 2), the input node 402 is electrically coupled to an output of the RF signal source (e.g., RF signal source 220, FIG. 2), and the output node 404 is electrically coupled to an electrode (e.g., first electrode 240, FIG. 2) within the defrosting cavity (e.g., defrosting cavity 260, FIG. 2).

Between the input and output nodes 402, 404, the variable impedance matching network 400 includes a first variable capacitance network 442 coupled in series with an inductor 454, and a second variable capacitance network 446 coupled between an intermediate node 451 and a ground reference terminal (e.g., the grounded containment structure 266, FIG. 2), in an embodiment. The inductor 454 may be designed for relatively low frequency (e.g., about 40.66 MHz to about 40.70 MHz) and high power (e.g., about 50 W to about 500 W) operation, in an embodiment. For example, inductor 454 may have a value in a range of about 200 nH to about 600 nH, although its value may be lower and/or higher, in other embodiments. According to an embodiment, inductor 454 is a fixed-value, lumped inductor (e.g., a coil). In other embodiments, the inductance value of inductor 454 may be variable.

The first variable capacitance network 442 is coupled between the input node 402 and the intermediate node 411, and the first variable capacitance network 442 may be referred to as a "series matching portion" of the variable impedance matching network 400. According to an embodiment, the first variable capacitance network 442 includes a first fixed-value capacitor 443 coupled in parallel with a first variable capacitor 444. The first fixed-value capacitor 443 may have a capacitance value in a range of about 1 picofarad (pF) to about 100 pF, in an embodiment. The first variable capacitor 444 may include a network of capacitive components that may be selectively coupled together to provide capacitances in a range of 0 pF to about 100 pF. Accordingly, the total capacitance value provided by the first variable capacitance network 442 may be in a range of about 1 pF to about 200 pF, although the range may extend to lower or higher capacitance values, as well.

A "shunt matching portion" of the variable impedance matching network 400 is provided by the second variable capacitance network 446, which is coupled between node 451 (located between the first variable capacitance network 442 and lumped inductor 454) and the ground reference terminal. According to an embodiment, the second variable capacitance network 446 includes a second fixed-value capacitor 447 coupled in parallel with a second variable capacitor 448. The second fixed-value capacitor 447 may have a capacitance value in a range of about 1 pF to about 100 pF, in an embodiment. The second variable capacitor 448 may include a network of capacitive components that may be selectively coupled together to provide capacitances in a range of 0 pF to about 100 pF. Accordingly, the total capacitance value provided by the second variable capacitance network 446 may be in a range of about 1 pF to about 200 pF, although the range may extend to lower or higher capacitance values, as well. The states of the first and second variable capacitance networks 442, 446 may be changed to provide multiple capacitance values, and thus may be configurable to optimally match the impedance of the cavity plus load (e.g., cavity 260 plus load 264, FIG. 2) to the RF signal source (e.g., RF signal source 220, FIG. 2).

According to an embodiment, portions of an arc detection sub-system are incorporated in the network 400. More specifically, non-linear devices 1702, 1704, 1706, and 1708 (e.g., gas discharge tubes, spark gaps, and/or TVS diodes) have been added so that a rapid impedance change is triggered whenever the voltage across one of the non-linear devices 1702, 1704, 1706, and 1708 exceeds a breakdown voltage of that non-linear device.

The non-linear device 1702 may be coupled in parallel with the variable capacitance network 442. The non-linear device 1704 may be coupled in parallel with the variable capacitance network 446. The non-linear device 1706 may be coupled in parallel with the inductance 454. The breakdown voltage of a given non-linear device of the non-linear devices 1702, 1704, and 1706 may be less than (e.g., by a defined percentage, such as 10% less than) a voltage at which arcing is expected to occur at the circuit component parallel to that non-linear device. In this way, the non-linear device will transition from being insulating to being conductive before electrical arcing can occur at its parallel circuit component, causing a detectable change in the impedance of the circuit 400. For example, if the variable capacitance network 442 is expected to experience electrical arcing at 1000 V, the non-linear device 1702 may have a breakdown voltage of 900 V. The voltage rating of readily available gas discharge devices ranges from less than 50 V to over 8000 V. The voltage is chosen to provide some margin to the maximum voltage of the protected component or, if connected between component to ground, the voltage that could cause an arc to ground. These voltages, and consequently the non-linear device rating, are determined as part of the system design through simulation or testing.

In some embodiments, arcing may be at risk of occurring at the output node 404, between the electrode (e.g., first electrode 240, FIG. 2) to which it is connected and a nearby grounded structure (e.g., containment structure 266). In order to prevent such arcing, the non-linear device 1708 may be coupled between the node 404 and ground. In this way, excessive voltage accumulated at the node 404 (e.g., exceeding the breakdown voltage of the non-linear device 1708) may cause a detectable change in the impedance of the network 400.

The description associated with FIGS. 2-4 discuss, in detail, an "unbalanced" defrosting apparatus, in which an RF signal is applied to one electrode (e.g., electrode 240, FIG. 2), and the other "electrode" (e.g., the containment structure 266, FIG. 2) is grounded. As mentioned above, an alternate embodiment of a defrosting apparatus comprises a "balanced" defrosting apparatus. In such an apparatus, balanced RF signals are provided to both electrodes.

For example, FIG. 5 is a simplified block diagram of a balanced defrosting system 500 (e.g., defrosting system 100, 210, 220, FIGS. 1, 2), in accordance with an example embodiment. Defrosting system 500 includes RF subsystem 510, defrosting cavity 560, user interface 580, system controller 512, RF signal source 520, power supply and bias circuitry 526, variable impedance matching network 570, two electrodes 540, 550, and power detection circuitry 530, in an embodiment. In addition, in other embodiments, defrosting system 500 may include temperature sensor(s), infrared (IR) sensor(s), and/or weight sensor(s) 590, although some or all of these sensor components may be excluded. It should be understood that FIG. 5 is a simplified representation of a defrosting system 500 for purposes of explanation and ease of description, and that practical embodiments may include other devices and components to provide additional functions and features, and/or the defrosting system 500 may be part of a larger electrical system.

User interface 580 may correspond to a control panel (e.g., control panel 120, FIG. 1), for example, which enables a user to provide inputs to the system regarding parameters for a defrosting operation (e.g., characteristics of the load to be defrosted, and so on), start and cancel buttons, mechanical controls (e.g., a door/drawer open latch), and so on. In addition, the user interface may be configured to provide user-perceptible outputs indicating the status of a defrosting operation (e.g., a countdown timer, visible indicia indicating progress or completion of the defrosting operation, and/or audible tones indicating completion of the defrosting operation) and other information.

The RF subsystem 510 includes a system controller 512, an RF signal source 520, a first impedance matching circuit 534 (herein "first matching circuit"), power supply and bias circuitry 526, and power detection circuitry 530, in an embodiment. System controller 512 may include one or more general purpose or special purpose processors (e.g., a microprocessor, microcontroller, ASIC, and so on), volatile and/or non-volatile memory (e.g., RAM, ROM, flash, various registers, and so on), one or more communication busses, and other components. According to an embodiment, system controller 512 is operatively and communicatively coupled to user interface 580, RF signal source 520, power supply and bias circuitry 526, power detection circuitry 530 (or 530' or 530"), variable matching subsystem 570, and sensor(s) 590 (if included). System controller 512 is configured to receive signals indicating user inputs received via user interface 580, to receive signals indicating RF signal reflected power (and possibly RF signal forward power) from power detection circuitry 530 (or 530' or 530"), and to receive sensor signals from sensor(s) 590. Responsive to the received signals and measurements, and as will be described in more detail later, system controller 512 provides control signals to the power supply and bias circuitry 526 and/or to the RF signal generator 522 of the RF signal source 520. In addition, system controller 512 provides control signals to the variable matching subsystem 570 (over path 516), which cause the subsystem 570 to change the state or configuration of a variable impedance matching circuit 572 of the subsystem 570 (herein "variable matching circuit").

Defrosting cavity 560 includes a capacitive defrosting arrangement with first and second parallel plate electrodes 540, 550 that are separated by an air cavity within which a load 564 to be defrosted may be placed. Within a containment structure 566, first and second electrodes 540, 550 (e.g., electrodes 170, 172, FIG. 1) are positioned in a fixed physical relationship with respect to each other on either side of an interior defrosting cavity 560 (e.g., interior cavity 110, FIG. 1). According to an embodiment, a distance 552 between the electrodes 540, 550 renders the cavity 560 a sub-resonant cavity, in an embodiment.

The first and second electrodes 540, 550 are separated across the cavity 560 by a distance 552. In various embodiments, the distance 552 is in a range of about 0.10 meters to about 1.0 meter, although the distance may be smaller or larger, as well. According to an embodiment, distance 552 is less than one wavelength of the RF signal produced by the RF subsystem 510. In other words, as mentioned above, the cavity 560 is a sub-resonant cavity. In some embodiments, the distance 552 is less than about half of one wavelength of the RF signal. In other embodiments, the distance 552 is less than about one quarter of one wavelength of the RF signal. In still other embodiments, the distance 552 is less than about one eighth of one wavelength of the RF signal. In still other embodiments, the distance 552 is less than about one 50th of one wavelength of the RF signal. In still other embodiments, the distance 552 is less than about one 100th of one wavelength of the RF signal.

In general, a system 500 designed for lower operational frequencies (e.g., frequencies between 10 MHz and 100 MHz) may be designed to have a distance 552 that is a smaller fraction of one wavelength. For example, when system 500 is designed to produce an RF signal with an operational frequency of about 10 MHz (corresponding to a wavelength of about 30 meters), and distance 552 is selected to be about 0.5 meters, the distance 552 is about one 60th of one wavelength of the RF signal. Conversely, when system 500 is designed for an operational frequency of about 300 MHz (corresponding to a wavelength of about 1 meter), and distance 552 is selected to be about 0.5 meters, the distance 552 is about one half of one wavelength of the RF signal.

With the operational frequency and the distance 552 between electrodes 540, 550 being selected to define a sub-resonant interior cavity 560, the first and second electrodes 540, 550 are capacitively coupled. More specifically, the first electrode 540 may be analogized to a first plate of a capacitor, the second electrode 550 may be analogized to a second plate of a capacitor, and the load 564, barrier 562, and air within the cavity 560 may be analogized to a capacitor dielectric. Accordingly, the first electrode 540 alternatively may be referred to herein as an "anode," and the second electrode 550 may alternatively be referred to herein as a "cathode."

Essentially, the voltage across the first and second electrodes 540, 550 heats the load 564 within the cavity 560. According to various embodiments, the RF subsystem 510 is configured to generate the RF signal to produce voltages across the electrodes 540, 550 in a range of about 50 volts to about 3000 volts, in one embodiment, or in a range of about 3000 volts to about 10,000 volts, in another embodiment, although the system may be configured to produce lower or higher voltages across electrodes 540, 550, as well.

An output of the RF subsystem 510, and more particularly an output of RF signal source 520, is electrically coupled to the variable matching subsystem 570 through a conductive transmission path, which includes a plurality of conductors 528-1, 528-2, 528-3, 528-4, and 528-5 connected in series, and referred to collectively as transmission path 528. According to an embodiment, the conductive transmission path 528 includes an "unbalanced" portion and a "balanced" portion, where the "unbalanced" portion is configured to carry an unbalanced RF signal (i.e., a single RF signal referenced against ground), and the "balanced" portion is configured to carry a balanced RF signal (i.e., two signals referenced against each other). The "unbalanced" portion of the transmission path 528 may include unbalanced first and second conductors 528-1, 528-2 within the RF subsystem 510, one or more connectors 536, 538 (each having male and female connector portions), and an unbalanced third conductor 528-3 electrically coupled between the connectors 536, 538. According to an embodiment, the third conductor 528-3 comprises a coaxial cable, although the electrical length may be shorter or longer, as well. In an alternate embodiment, the variable matching subsystem 570 may be housed with the RF subsystem 510, and in such an embodiment, the conductive transmission path 528 may exclude the connectors 536, 538 and the third conductor 528-3. Either way, the "balanced" portion of the conductive transmission path 528 includes a balanced fourth conductor 528-4 within the variable matching subsystem 570, and a balanced fifth conductor 528-5 electrically coupled between the variable matching subsystem 570 and electrodes 540, 550, in an embodiment.

As indicated in FIG. 5, the variable matching subsystem 570 houses an apparatus configured to receive, at an input of the apparatus, the unbalanced RF signal from the RF signal source 520 over the unbalanced portion of the transmission path (i.e., the portion that includes unbalanced conductors 528-1, 528-2, and 528-3), to convert the unbalanced RF signal into two balanced RF signals (e.g., two RF signals having a phase difference between 120 and 240 degrees, such as about 180 degrees), and to produce the two balanced RF signals at two outputs of the apparatus. For example, the conversion apparatus may be a balun 574, in an embodiment. The balanced RF signals are conveyed over balanced conductors 528-4 to the variable matching circuit 572 and, ultimately, over balanced conductors 528-5 to the electrodes 540, 550.

In an alternate embodiment, as indicated in a dashed box in the center of FIG. 5, and as will be discussed in more detail below, an alternate RF signal generator 520' may produce balanced RF signals on balanced conductors 528-1', which may be directly coupled to the variable matching circuit 572 (or coupled through various intermediate conductors and connectors). In such an embodiment, the balun 574 may be excluded from the system 500. Either way, as will be described in more detail below, a double-ended variable matching circuit 572 (e.g., variable matching circuit 600, 700, FIGS. 6, 7) is configured to receive the balanced RF signals (e.g., over connections 528-4 or 528-1'), to perform an impedance transformation corresponding to a then-current configuration of the double-ended variable matching circuit 572, and to provide the balanced RF signals to the first and second electrodes 540, 550 over connections 528-5.

According to an embodiment, RF signal source 520 includes an RF signal generator 522 and a power amplifier 524 (e.g., including one or more power amplifier stages). In response to control signals provided by system controller 512 over connection 514, RF signal generator 522 is configured to produce an oscillating electrical signal having a frequency in an ISM (industrial, scientific, and medical) band, although the system could be modified to support operations in other frequency bands, as well. The RF signal generator 522 may be controlled to produce oscillating signals of different power levels and/or different frequencies, in various embodiments. For example, the RF signal generator 522 may produce a signal that oscillates in the VHF range (i.e., in a range between about 30.0 MHz and about 300 MHz), and/or in a range of about 10.0 MHz to about 100 MHz and/or in a range of about 100 MHz to about 3.0 GHz. Some desirable frequencies may be, for example, 13.56 MHz (+/−5 percent), 27.125 MHz (+/−5 percent), 40.68 MHz (+/−5 percent), and 2.45 GHz (+/−5 percent). Alternatively, the frequency of oscillation may be lower or higher than the above-given ranges or values.

The power amplifier 524 is configured to receive the oscillating signal from the RF signal generator 522, and to amplify the signal to produce a significantly higher-power signal at an output of the power amplifier 524. For example, the output signal may have a power level in a range of about 100 watts to about 400 watts or more, although the power level may be lower or higher, as well. The gain applied by the power amplifier 524 may be controlled using gate bias voltages and/or drain bias voltages provided by the power supply and bias circuitry 526 to one or more stages of amplifier 524. More specifically, power supply and bias circuitry 526 provides bias and supply voltages to the inputs and/or outputs (e.g., gates and/or drains) of each RF amplifier stage in accordance with control signals received from system controller 512.

The power amplifier may include one or more amplification stages. In an embodiment, each stage of amplifier 524 is implemented as a power transistor, such as a FET, having an input terminal (e.g., a gate or control terminal) and two current carrying terminals (e.g., source and drain terminals). Impedance matching circuits (not illustrated) may be coupled to the input (e.g., gate) and/or output (e.g., drain terminal) of some or all of the amplifier stages, in various embodiments. In an embodiment, each transistor of the amplifier stages includes an LDMOS FET. However, it should be noted that the transistors are not intended to be limited to any particular semiconductor technology, and in other embodiments, each transistor may be realized as a GaN transistor, another type of MOS FET transistor, a BJT, or a transistor utilizing another semiconductor technology.

In FIG. 5, the power amplifier arrangement 524 is depicted to include one amplifier stage coupled in a particular manner to other circuit components. In other embodiments, the power amplifier arrangement 524 may include other amplifier topologies and/or the amplifier arrangement may include two or more amplifier stages (e.g., as shown in the embodiment of amplifier 224/225, FIG. 2). For example, the power amplifier arrangement may include various embodiments of a single-ended amplifier, a double-ended (balanced) amplifier, a push-pull amplifier, a Doherty amplifier, a Switch Mode Power Amplifier (SMPA), or another type of amplifier.

For example, as indicated in the dashed box in the center of FIG. 5, an alternate RF signal generator 520' may include a push-pull or balanced amplifier 524', which is configured to receive, at an input, an unbalanced RF signal from the RF signal generator 522, to amplify the unbalanced RF signal, and to produce two balanced RF signals at two outputs of the amplifier 524', where the two balanced RF signals are thereafter conveyed over conductors 528-1' to the electrodes 540, 550. In such an embodiment, the balun 574 may be excluded from the system 500, and the conductors 528-1' may be directly connected to the variable matching circuit 572 (or connected through multiple coaxial cables and connectors or other multi-conductor structures).

Defrosting cavity 560 and any load 564 (e.g., food, liquids, and so on) positioned in the defrosting cavity 560 present a cumulative load for the electromagnetic energy (or RF power) that is radiated into the interior chamber 562 by the electrodes 540, 550. More specifically, and as described previously, the defrosting cavity 560 and the load 564 present an impedance to the system, referred to herein as a "cavity plus load impedance." The cavity plus load impedance changes during a defrosting operation as the temperature of the load 564 increases. The cavity plus load impedance has a direct effect on the magnitude of reflected signal power along the conductive transmission path 528 between the RF signal source 520 and the electrodes 540, 550. In most cases, it is desirable to maximize the magnitude of transferred signal power into the cavity 560, and/or to minimize the reflected-to-forward signal power ratio along the conductive transmission path 528.

In order to at least partially match the output impedance of the RF signal generator 520 to the cavity plus load impedance, a first matching circuit 534 is electrically coupled along the transmission path 528, in an embodiment. The first matching circuit 534 is configured to perform an impedance transformation from an impedance of the RF signal source 520 (e.g., less than about 10 ohms) to an intermediate impedance (e.g., 50 ohms, 75 ohms, or some other value). The first matching circuit 534 may have any of a variety of configurations. According to an embodiment, the first matching circuit 534 includes fixed components (i.e., components with non-variable component values), although the first matching circuit 534 may include one or more variable components, in other embodiments. For example, the first matching circuit 534 may include any one or more circuits selected from an inductance/capacitance (LC) network, a series inductance network, a shunt inductance network, or a combination of bandpass, high-pass and low-pass circuits, in various embodiments. Essentially, the first matching circuit 534 is configured to raise the impedance to an intermediate level between the output impedance of the RF signal generator 520 and the cavity plus load impedance.

According to an embodiment, and as mentioned above, power detection circuitry 530 is coupled along the transmission path 528 between the output of the RF signal source 520 and the electrodes 540, 550. In a specific embodiment, the power detection circuitry 530 forms a portion of the RF subsystem 510, and is coupled to the conductor 528-2 between the RF signal source 520 and connector 536. In alternate embodiments, the power detection circuitry 530 may be coupled to any other portion of the transmission path 528, such as to conductor 528-1, to conductor 528-3, to conductor 528-4 between the RF signal source 520 (or balun 574) and the variable matching circuit 572 (i.e., as indicated with power detection circuitry 530'), or to conductor 528-5 between the variable matching circuit 572 and the electrode(s) 540, 550 (i.e., as indicated with power detection circuitry 530"). For purposes of brevity, the power detection circuitry is referred to herein with reference number 530, although the circuitry may be positioned in other locations, as indicated by reference numbers 530' and 530".

Wherever it is coupled, power detection circuitry 530 is configured to monitor, measure, or otherwise detect the power of the reflected signals traveling along the transmission path 528 between the RF signal source 520 and one or both of the electrode(s) 540, 550 (i.e., reflected RF signals traveling in a direction from electrode(s) 540, 550 toward RF signal source 520). In some embodiments, power detection circuitry 530 also is configured to detect the power of the forward signals traveling along the transmission path 528 between the RF signal source 520 and the electrode(s) 540, 550 (i.e., forward RF signals traveling in a direction from RF signal source 520 toward electrode(s) 540, 550).

Over connection 532, power detection circuitry 530 supplies signals to system controller 512 conveying the measured magnitudes of the reflected signal power, and in some embodiments, also the measured magnitude of the forward signal power. In embodiments in which both the forward and reflected signal power magnitudes are conveyed, system controller 512 may calculate a reflected-to-forward signal power ratio, or the S11 parameter, and/or a VSWR value. As will be described in more detail below, when the reflected signal power magnitude exceeds a reflected signal power threshold, or when the reflected-to-forward signal power ratio exceeds an S11 parameter threshold, or when the VSWR value exceeds a VSWR threshold, this indicates that the system 500 is not adequately matched to the cavity plus load impedance, and that energy absorption by the load 564 within the cavity 560 may be sub-optimal. In such a situation, system controller 512 orchestrates a process of altering the state of the variable matching circuit 572 to drive the reflected signal power or the S11 parameter or the VSWR value toward or below a desired level (e.g., below the reflected signal power threshold, and/or the reflected-to-forward signal power ratio threshold, and/or the VSWR threshold), thus re-establishing an acceptable match and facilitating more optimal energy absorption by the load 564.

In some embodiments, the system controller 512 and power detection circuitry 530 may detect the rapid change in impedance (e.g., as a rapid change in the S11 parameter, VSWR, and/or current derived by the system controller 512 from measurements made by the power detection circuitry 530) associated with the breakdown voltage of a non-linear device in the variable impedance matching circuit 570 being exceeded. For example, if the system controller 512 determines that the rate of change of the S11 parameter and/or the VSWR value exceeds a predetermined threshold value, which may indicate an arcing condition, the system 500 may modify component values of the variable matching circuit 572 to attempt to correct the arcing condition or, alternatively, may reduce the power of or discontinue or modify (e.g., by reducing a power of) supply of the RF signal by the RF signal source 520 in order to prevent uncontrolled electrical arcing.

More specifically, the system controller 512 may provide control signals over control path 516 to the variable matching circuit 572, which cause the variable matching circuit 572 to vary inductive, capacitive, and/or resistive values of one or more components within the circuit, thus adjusting the impedance transformation provided by the circuit 572. Adjustment of the configuration of the variable matching circuit 572 desirably decreases the magnitude of reflected signal power, which corresponds to decreasing the magnitude of the S11 parameter and/or the VSWR value, and increasing the power absorbed by the load 564.

As discussed above, the variable matching circuit 572 is used to match the input impedance of the defrosting cavity 560 plus load 564 to maximize, to the extent possible, the RF power transfer into the load 564. The initial impedance of the defrosting cavity 560 and the load 564 may not be known with accuracy at the beginning of a defrosting operation. Further, the impedance of the load 564 changes during a defrosting operation as the load 564 warms up. According to an embodiment, the system controller 512 may provide control signals to the variable matching circuit 572, which cause modifications to the state of the variable matching circuit 572. This enables the system controller 512 to establish an initial state of the variable matching circuit 572 at the beginning of the defrosting operation that has a relatively low reflected to forward power ratio, and thus a relatively high absorption of the RF power by the load 564. In addition, this enables the system controller 512 to modify the state of the variable matching circuit 572 so that an adequate match may be maintained throughout the defrosting operation, despite changes in the impedance of the load 564.

The variable matching circuit 572 may have any of a variety of configurations. For example, the circuit 572 may include any one or more circuits selected from an inductance/capacitance (LC) network, an inductance-only network, a capacitance-only network, or a combination of bandpass, high-pass and low-pass circuits, in various embodiments. In an embodiment in which the variable matching circuit 572 is implemented in a balanced portion of the transmission path 528, the variable matching circuit 572 is a double-ended circuit with two inputs and two outputs. In an alternate embodiment in which the variable matching circuit is implemented in an unbalanced portion of the transmission path 528, the variable matching circuit may be a single-ended circuit with a single input and a single output (e.g., similar to matching circuit 300 or 400, FIGS. 3, 4). According to a more specific embodiment, the variable matching circuit 572 includes a variable inductance network (e.g., double-ended network 600, FIG. 6). According to another more specific embodiment, the variable matching circuit 572 includes a variable capacitance network (e.g., double-ended network 700, FIG. 7). In still other embodiments, the variable matching circuit 572 may include both variable inductance and variable capacitance elements. The inductance, capacitance, and/or resistance values provided by the variable matching circuit 572, which in turn affect the impedance transformation provided by the circuit 572, are established through control signals from the system controller 512, as will be described in more detail later. In any event, by changing the state of the variable matching circuit 572 over the course of a treatment operation to dynamically match the ever-changing impedance of the cavity 560 plus the load 564 within the cavity 560, the system efficiency may be maintained at a high level throughout the defrosting operation.

In some embodiments, non-linear devices (e.g., gas discharge tubes, spark gaps, TVS diodes, etc.) may be coupled in parallel across any or all of the fixed and variable components (e.g., individual inductors, individual capacitors, lumped inductors, lumped capacitors, variable capacitor networks, variable inductor networks, etc.) of the variable impedance matching network 572. Each of these non-linear devices may have an individual breakdown voltage, such that when a voltage across a given non-linear device (e.g., and therefore a voltage across the fixed or variable component coupled in parallel with that non-linear device) exceeds the individual breakdown voltage for that non-linear device, the given non-linear device begins to conduct, rapidly changing the impedance of the variable impedance matching network 572. The non-linear device coupled to a particular component of the variable impedance matching network 572 may have a breakdown voltage that is less than (e.g., a fraction of) a maximum operating voltage of the component, above which arcing may occur at the component or the component may be damaged. For example, the component may be a capacitor that is rated for a maximum operating voltage of 1000 V, and the non-linear device coupled to the capacitor may have a breakdown voltage of 900 V, so that the non-linear device will begin to conduct and change the impedance of the variable impedance matching network 572 before the maximum operating voltage of the capacitor is reached. The system controller 512 may detect the change in impedance of the variable impedance matching network 572 caused by the breakdown voltage of the non-linear device being exceeded (e.g., based on the rate of change of an S11 parameter and/or VSWR value measured at the RF signal source 520), and may cause the RF signal supplied by the RF signal source 520 to be reduced in power or stopped so that the maximum operating voltage of the capacitor is not exceeded.

Figure 6:
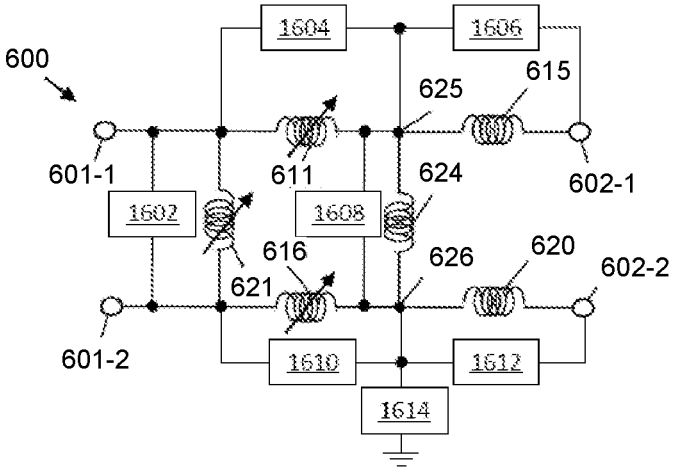
FIG. 6 is a schematic diagram of a double-ended variable impedance matching network with variable inductances, in accordance with another example embodiment.
Figure 7:
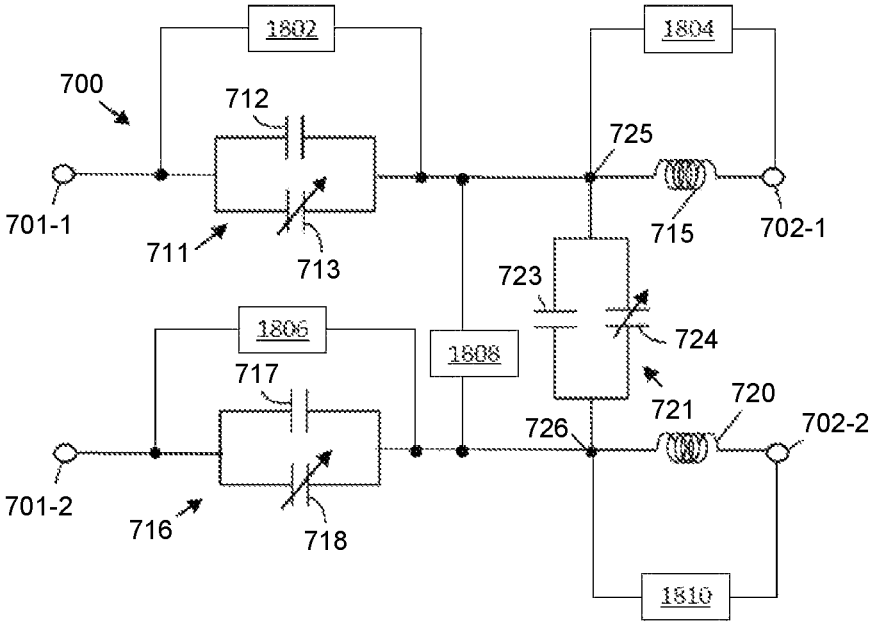
FIG. 7 is a schematic diagram of a double-ended variable impedance network with variable capacitances, in accordance with another example embodiment.

The variable matching circuit 572 may have any of a wide variety of circuit configurations, and non-limiting examples of such configurations are shown in FIGS. 6 and 7. For example, FIG. 6 is a schematic diagram of a double-ended variable impedance matching circuit 600 that may be incorporated into a defrosting system (e.g., system 100, 500, FIGS. 1, 5), in accordance with an example embodiment. According to an embodiment, the variable matching circuit 600 includes a network of fixed-value and variable passive components.

Circuit 600 includes a double-ended input 601-1, 601-2 (referred to as input 601), a double-ended output 602-1, 602-2 (referred to as output 602), and a network of passive components connected in a ladder arrangement between the input 601 and output 602. For example, when connected into system 500, the first input 601-1 may be connected to a first conductor of balanced conductor 528-4, and the second input 601-2 may be connected to a second conductor of balanced conductor 528-4. Similarly, the first output 602-1 may be connected to a first conductor of balanced conductor 528-5, and the second output 602-2 may be connected to a second conductor of balanced conductor 528-5.

In the specific embodiment illustrated in FIG. 6, circuit 600 includes a first variable inductor 611 and a first fixed inductor 615 connected in series between input 601-1 and output 602-1, a second variable inductor 616 and a second fixed inductor 620 connected in series between input 601-2 and output 602-2, a third variable inductor 621 connected between inputs 601-1 and 601-2, and a third fixed inductor 624 connected between nodes 625 and 626.

According to an embodiment, the third variable inductor 621 corresponds to an "RF signal source matching portion", which is configurable to match the impedance of the RF signal source (e.g., RF signal source 520, FIG. 5) as modified by the first matching circuit (e.g., circuit 534, FIG. 5), or more particularly to match the impedance of the final stage power amplifier (e.g., amplifier 524, FIG. 5) as modified by the first matching circuit (e.g., circuit 534, FIG. 5). According to an embodiment, the third variable inductor 621 includes a network of inductive components that may be selectively coupled together to provide inductances in a range of about 5 nH to about 200 nH, although the range may extend to lower or higher inductance values, as well.

In contrast, the "cavity matching portion" of the variable impedance matching network 600 is provided by the first and second variable inductors 611, 616, and fixed inductors 615, 620, and 624. Because the states of the first and second variable inductors 611, 616 may be changed to provide multiple inductance values, the first and second variable inductors 611, 616 are configurable to optimally match the impedance of the cavity plus load (e.g., cavity 560 plus load 564, FIG. 5). For example, inductors 611, 616 each may have a value in a range of about 10 nH to about 200 nH, although their values may be lower and/or higher, in other embodiments.

The fixed inductors 615, 620, 624 also may have inductance values in a range of about 50 nH to about 800 nH, although the inductance values may be lower or higher, as well. Inductors 611, 615, 616, 620, 621, 624 may include discrete inductors, distributed inductors (e.g., printed coils), wirebonds, transmission lines, and/or other inductive components, in various embodiments. In an embodiment, variable inductors 611 and 616 are operated in a paired manner, meaning that their inductance values during operation are controlled to be equal to each other, at any given time, in order to ensure that the RF signals conveyed to outputs 602-1 and 602-2 are balanced.

As discussed above, variable matching circuit 600 is a double-ended circuit that is configured to be connected along a balanced portion of the transmission path 528 (e.g., between connectors 528-4 and 528-5), and other embodiments may include a single-ended (i.e., one input and one output) variable matching circuit that is configured to be connected along the unbalanced portion of the transmission path 528.

By varying the inductance values of inductors 611, 616, 621 in circuit 600, the system controller 512 may increase or decrease the impedance transformation provided by circuit 600. Desirably, the inductance value changes improve the overall impedance match between the RF signal source 520 and the cavity plus load impedance, which should result in a reduction of the reflected signal power and/or the reflected-to-forward signal power ratio. In most cases, the system controller 512 may strive to configure the circuit 600 in a state in which a maximum electromagnetic field intensity is achieved in the cavity 560, and/or a maximum quantity of power is absorbed by the load 564, and/or a minimum quantity of power is reflected by the load 564.

According to an embodiment, portions of an arc detection sub-system are incorporated in the network 600. More specifically, non-linear devices 1602, 1604, 1606, 1608, 1610, 1612, and 1614 (e.g., gas discharge tubes, spark gaps, and/or TVS diodes) have been added so that a rapid impedance change is triggered whenever the voltage across one of the non-linear devices 1602, 1604, 1606, 1608, 1610, 1612, and 1614 exceeds a breakdown voltage of that non-linear device.

The non-linear device 1602 may be coupled in parallel with the variable inductance network 621. The non-linear device 1604 may be coupled in parallel with the inductance 611. The non-linear device 1606 may be coupled in parallel with the inductance 615. The non-linear device 1608 may be coupled in parallel with the variable inductance network 624. The non-linear device 1610 may be coupled in parallel with the inductance 616. The non-linear device 1612 may be coupled in parallel with the inductance 620. The breakdown voltage of a given non-linear device of the non-linear devices 1602, 1604, 1606, 1608, 1610, and 1612 may be less than (e.g., by a defined percentage, such as 10% less than) a voltage at which arcing is expected to occur at the circuit component parallel to that non-linear device. In this way, the non-linear device will transition from being insulating to being conductive before electrical arcing can occur at its parallel circuit component, causing a detectable change in the impedance of the circuit 600. For example, if the inductance 615 is expected to experience electrical arcing at 1000 V, the non-linear device 1606 may have a breakdown voltage of 900 V. The voltage rating of readily available gas discharge devices ranges from less than 50 V to over 8000 V. The voltage is chosen to provide some margin to the maximum voltage of the protected component or, if connected between component to ground, the voltage that could cause an arc to ground. These voltages, and consequently the non-linear device rating, are determined as part of the system design through simulation or testing.

In addition to occurring at or across circuit components, electrical arcing may sometimes occur at locations where component connections, transmission lines or other conductive portions of the network 600 that are in close proximity to grounded structures (e.g., containment structure 266, 566, 1150, FIGS. 2, 5, 11), due to strong electric fields that may form between the two. Thus, non-linear devices may also be coupled between such transmission lines and corresponding grounded structures so that arcing between the two may be prevented. For example, if the node 626 is at risk of experiencing electrical arcing due to its proximity to a grounded structure, the non-linear device 1614 may be coupled between the node 626 and a ground terminal so that excessive voltage accumulated at the node 626 (e.g., exceeding the breakdown voltage of the non-linear device 1614) may cause a detectable change in the impedance of the network 600.

FIG. 7 is a schematic diagram of a double-ended variable impedance matching circuit 700 that may be incorporated into a defrosting system (e.g., system 100, 500, FIGS. 1, 5), in accordance with another example embodiment. As with the matching circuit 600 (FIG. 6), according to an embodiment, the variable matching circuit 700 includes a network of fixed-value and variable passive components.

Circuit 700 includes a double-ended input 701-1, 701-2 (referred to as input 701), a double-ended output 702-1, 702-2 (referred to as output 702), and a network of passive components connected between the input 701 and output 702. For example, when connected into system 500, the first input 701-1 may be connected to a first conductor of balanced conductor 528-4, and the second input 701-2 may be connected to a second conductor of balanced conductor 528-4. Similarly, the first output 702-1 may be connected to a first conductor of balanced conductor 528-5, and the second output 702-2 may be connected to a second conductor of balanced conductor 528-5.

In the specific embodiment illustrated in FIG. 7, circuit 700 includes a first variable capacitance network 711 and a first inductor 715 connected in series between input 701-1 and output 702-1, a second variable capacitance network 716 and a second inductor 720 connected in series between input 701-2 and output 702-2, and a third variable capacitance network 721 connected between nodes 725 and 726. The inductors 715, 720 are relatively large in both size and inductance value, in an embodiment, as they may be designed for relatively low frequency (e.g., about 40.66 MHz to about 40.70 MHz) and high power (e.g., about 50 W to about 500 W) operation. For example, inductors 715, 720 each may have a value in a range of about 100 nH to about 1000 nH (e.g., in a range of about 200 nH to about 600 nH), although their values may be lower and/or higher, in other embodiments. According to an embodiment, inductors 715, 720 are fixed-value, lumped inductors (e.g., coils, discrete inductors, distributed inductors (e.g., printed coils), wirebonds, transmission lines, and/or other inductive components, in various embodiments). In other embodiments, the inductance value of inductors 715, 720 may be variable. In any event, the inductance values of inductors 715, 720 are substantially the same either permanently (when inductors 715, 720 are fixed-value) or at any given time (when inductors 715, 720 are variable, they are operated in a paired manner), in an embodiment.

The first and second variable capacitance networks 711, 716 correspond to "series matching portions" of the circuit 700. According to an embodiment, the first variable capacitance network 711 includes a first fixed-value capacitor 712 coupled in parallel with a first variable capacitor 713. The first fixed-value capacitor 712 may have a capacitance value in a range of about 1 pF to about 100 pF, in an embodiment. As was described previously in conjunction with FIG. 5B, the first variable capacitor 713 may include a network of capacitive components that may be selectively coupled together to provide capacitances in a range of 0 pF to about 100 pF. Accordingly, the total capacitance value provided by the first variable capacitance network 711 may be in a range of about 1 pF to about 200 pF, although the range may extend to lower or higher capacitance values, as well.

Similarly, the second variable capacitance network 716 includes a second fixed-value capacitor 717 coupled in parallel with a second variable capacitor 718. The second fixed-value capacitor 717 may have a capacitance value in a range of about 1 pF to about 100 pF, in an embodiment. As was described previously in conjunction with FIG. 5B, the second variable capacitor 718 may include a network of capacitive components that may be selectively coupled together to provide capacitances in a range of 0 pF to about 100 pF. Accordingly, the total capacitance value provided by the second variable capacitance network 716 may be in a range of about 1 pF to about 200 pF, although the range may extend to lower or higher capacitance values, as well.

In any event, to ensure the balance of the signals provided to outputs 702-1 and 702-2, the capacitance values of the first and second variable capacitance networks 711, 716 are controlled to be substantially the same at any given time, in an embodiment. For example, the capacitance values of the first and second variable capacitors 713, 718 may be controlled so that the capacitance values of the first and second variable capacitance networks 711, 716 are substantially the same at any given time. The first and second variable capacitors 713, 718 are operated in a paired manner, meaning that their capacitance values during operation are controlled, at any given time, to ensure that the RF signals conveyed to outputs 702-1 and 702-2 are balanced. The capacitance values of the first and second fixed-value capacitors 712, 717 may be substantially the same, in some embodiments, although they may be different, in others.

The "shunt matching portion" of the variable impedance matching network 700 is provided by the third variable capacitance network 721 and fixed inductors 715, 720. According to an embodiment, the third variable capacitance network 721 includes a third fixed-value capacitor 723 coupled in parallel with a third variable capacitor 724. The third fixed-value capacitor 723 may have a capacitance value in a range of about 1 pF to about 500 pF, in an embodiment. As was described previously in conjunction with FIG. 5B, the third variable capacitor 724 may include a network of capacitive components that may be selectively coupled together to provide capacitances in a range of 0 pF to about 200 pF. Accordingly, the total capacitance value provided by the third variable capacitance network 721 may be in a range of about 1 pF to about 700 pF, although the range may extend to lower or higher capacitance values, as well.

Because the states of the variable capacitance networks 711, 716, 721 may be changed to provide multiple capacitance values, the variable capacitance networks 711, 716, 721 are configurable to optimally match the impedance of the cavity plus load (e.g., cavity 560 plus load 564, FIG. 5) to the RF signal source (e.g., RF signal source 520, 520', FIG. 5). By varying the capacitance values of capacitors 713, 718, 724 in circuit 700, the system controller (e.g., system controller 512, FIG. 5) may increase or decrease the impedance transformation provided by circuit 700. Desirably, the capacitance value changes improve the overall impedance match between the RF signal source 520 and the impedance of the cavity plus load, which should result in a reduction of the reflected signal power and/or the reflected-to-forward signal power ratio. In most cases, the system controller 512 may strive to configure the circuit 700 in a state in which a maximum electromagnetic field intensity is achieved in the cavity 560, and/or a maximum quantity of power is absorbed by the load 564, and/or a minimum quantity of power is reflected by the load 564.

According to an embodiment, portions of an arc detection sub-system are incorporated in the network 700. More specifically, non-linear devices 1802, 1804, 1806, 1808, and 1810 (e.g., gas discharge tubes, spark gaps, and/or TVS diodes) have been added so that a rapid impedance change is triggered whenever the voltage across one of the non-linear devices 1802, 1804, 1806, 1808, and 1810 exceeds a breakdown voltage of that non-linear device.

The non-linear device 1802 may be coupled in parallel with the variable capacitance network 711. The non-linear device 1806 may be coupled in parallel with the variable capacitance network 716. The non-linear device 1808 may be coupled in parallel with the variable capacitance network 721. The non-linear device 1804 may be coupled in parallel with the inductor 715. The non-linear device 1810 may be coupled in parallel with the inductor 720. The breakdown voltage of a given non-linear device of the non-linear devices 1802, 1804, 1806, 1808, and 1810 may be less than (e.g., by a defined percentage, such as 10% less than) a voltage at which arcing is expected to occur at the circuit component parallel to that non-linear device. In this way, the non-linear device will transition from being insulating to being conductive before electrical arcing can occur at its parallel circuit component, causing a detectable change in the impedance of the circuit 1800. For example, if the variable capacitance network 442 is expected to experience electrical arcing at 1000 V, the non-linear device 1702 may have a breakdown voltage of 900 V. The voltage rating of readily available gas discharge devices ranges from less than 50 V to over 8000 V. The voltage is chosen to provide some margin to the maximum voltage of the protected component or, if connected between component to ground, the voltage that could cause an arc to ground. These voltages, and consequently the non-linear device rating, are determined as part of the system design through simulation or testing.

It should be understood that the variable impedance matching circuits 600, 700 illustrated in FIGS. 6 and 7 are but two possible circuit configurations that may perform the desired double-ended variable impedance transformations. Other embodiments of double-ended variable impedance matching circuits may include differently arranged inductive or capacitive networks, or may include passive networks that include various combinations of inductors, capacitors, and/or resistors, where some of the passive components may be fixed-value components, and some of the passive components may be variable-value components (e.g., variable inductors, variable capacitors, and/or variable resistors). Further, the double-ended variable impedance matching circuits may include active devices (e.g., transistors) that switch passive components into and out of the network to alter the overall impedance transformation provided by the circuit.

While the preceding examples of FIGS. 3, 4, 6, and 7 are described in connection with particular variable impedance matching network circuit layouts, other embodiments of variable impedance matching networks that include other arrangements of variable passive components (e.g., variable capacitors, variable resistors, variable inductors and/or combinations thereof) may also be susceptible to electrical arcing during operation. It should therefore be understood that the non-linear devices described in connection with FIGS. 3, 4, 6, and 7 may be applicable to embodiments of defrosting systems or other RF systems that include alternate variable impedance matching network component arrangements, with similarly rapid changes to S11 parameters, VSWR, or other signal parameters generally resulting from the voltage across a non-linear device exceeding a breakdown voltage of that device. Additionally, it should be noted that the inclusion of non-linear devices in defrosting systems, as described in connection with FIGS. 3, 4, 6, and 7, is intended to be illustrative and not limiting. Non-linear devices of the type described above may be incorporated into any matching circuitry coupled between an RF signal source and a load of a system in order to detect over-voltage conditions at components of the matching circuitry so that an operation of the system may be modified to prevent electrical arcing.

According to various embodiments, the circuitry associated with the single-ended or double-ended variable impedance matching networks discussed herein may be implemented in the form of one or more modules, where a "module" is defined herein as an assembly of electrical components coupled to a common substrate. In addition, in various embodiments, the circuitry associated with the RF subsystem (e.g., RF subsystem 210, 510, FIGS. 2, 5) also may be implemented in the form of one or more modules.

Figure 8:
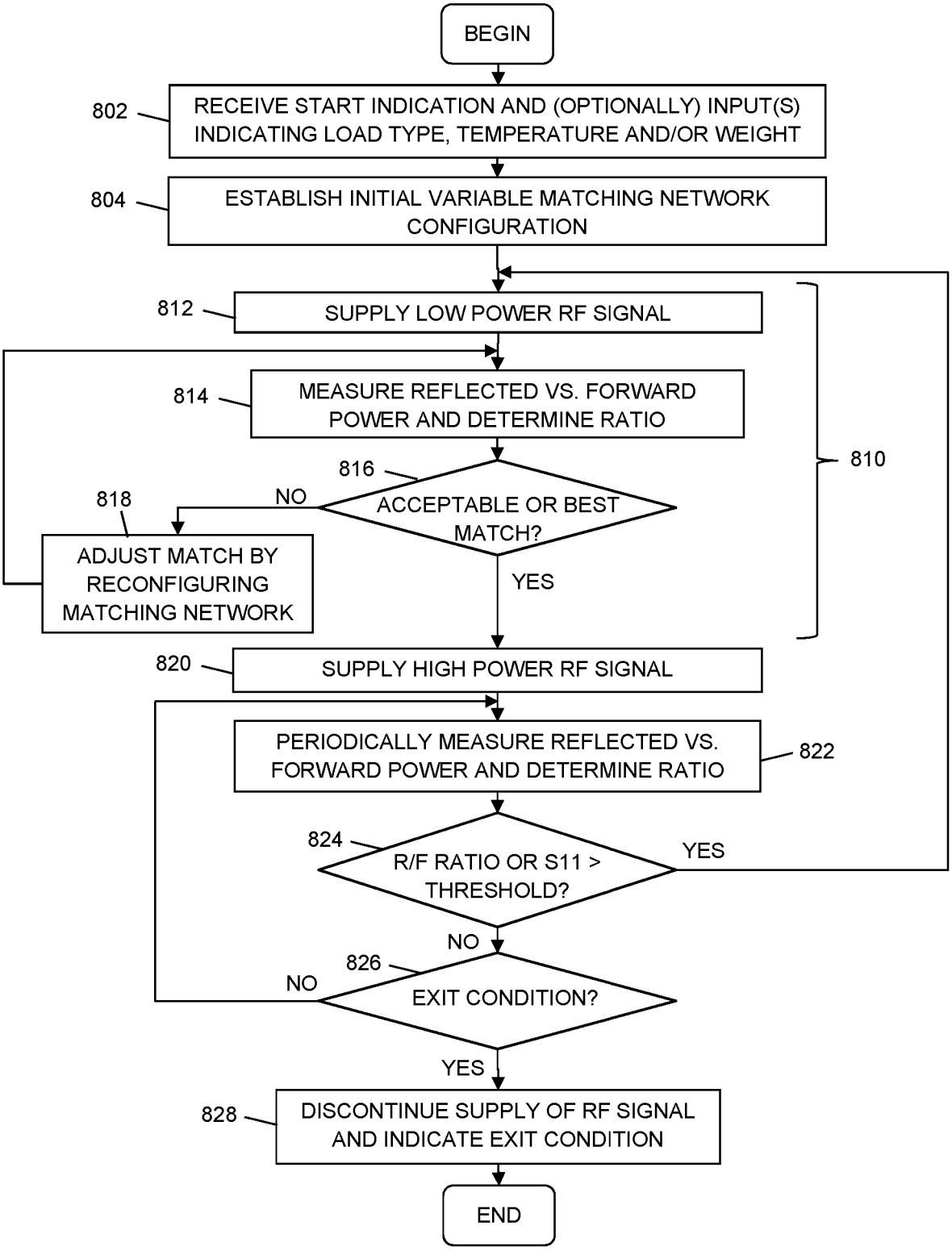
FIG. 8 is a flowchart of a method of operating a defrosting system with dynamic load matching, in accordance with an example embodiment.

Now that embodiments of the electrical and physical aspects of defrosting systems have been described, various embodiments of methods for operating such defrosting systems will now be described in conjunction with FIGS. 8 and 9. More specifically, FIG. 8 is a flowchart of a method of operating a defrosting system (e.g., system 100, 200, 500, FIGS. 1, 2, 5) with dynamic load matching, in accordance with an example embodiment.

The method may begin, in block 802, when the system controller (e.g., system controller 212, 512, FIGS. 2, 5) receives an indication that a defrosting operation should start. Such an indication may be received, for example, after a user has place a load (e.g., load 264, 564, FIGS. 2, 5) into the system's defrosting cavity (e.g., cavity 260, 560, FIGS. 2, 5), has sealed the cavity (e.g., by closing a door or drawer), and has pressed a start button (e.g., of the user interface 280, 580, FIGS. 2, 5). In an embodiment, sealing of the cavity may engage one or more safety interlock mechanisms, which when engaged, indicate that RF power supplied to the cavity will not substantially leak into the environment outside of the cavity. As will be described later, disengagement of a safety interlock mechanism may cause the system controller immediately to pause or terminate the defrosting operation.

According to various embodiments, the system controller optionally may receive additional inputs indicating the load type (e.g., meats, liquids, or other materials), the initial load temperature, and/or the load weight. For example, information regarding the load type may be received from the user through interaction with the user interface (e.g., by the user selecting from a list of recognized load types). Alternatively, the system may be configured to scan a barcode visible on the exterior of the load, or to receive an electronic signal from an RFID device on or embedded within the load. Information regarding the initial load temperature may be received, for example, from one or more temperature sensors and/or IR sensors (e.g., sensors 290, 590, FIGS. 2, 5) of the system. Information regarding the load weight may be received from the user through interaction with the user interface, or from a weight sensor (e.g., sensor 290, 590, FIGS. 2, 5) of the system. As indicated above, receipt of inputs indicating the load type, initial load temperature, and/or load weight is optional, and the system alternatively may not receive some or all of these inputs.

In block 804, the system controller provides control signals to the variable matching network (e.g., network 270, 300, 400, 572, 600, 700, FIGS. 2-7) to establish an initial configuration or state for the variable matching network. As described in detail in conjunction with FIGS. 3, 4, 6, and 7, the control signals affect the values of various inductances and/or capacitances (e.g., inductances 310, 311, 611, 616, 621, FIGS. 3, 6, and capacitances 444, 448, 713, 718, 724, FIGS. 4, 7) within the variable matching network. For example, the control signals may affect the states of bypass switches, which are responsive to the control signals from the system controller.

As also discussed previously, a first portion of the variable matching network may be configured to provide a match for the RF signal source (e.g., RF signal source 220, 520, FIGS. 2, 5) or the final stage power amplifier (e.g., power amplifier 225, 524, FIGS. 2, 5), and a second portion of the variable matching network may be configured to provide a match for the cavity (e.g., cavity 260, 560, FIGS. 2, 5) plus the load (e.g., load 264, 564, FIGS. 2, 5). For example, referring to FIG. 3, a first shunt, variable inductance network 310 may be configured to provide the RF signal source match, and a second shunt, variable inductance network 316 may be configured to provide the cavity plus load match. Referring to FIG. 4, a first variable capacitance network 442, in conjunction with a second variable capacitance network 446, may be both configured to provide an optimum match between the RF signal source and the cavity plus load.

Once the initial variable matching network configuration is established, the system controller may perform a process 810 of adjusting, if necessary, the configuration of the variable impedance matching network to find an acceptable or best match based on actual measurements that are indicative of the quality of the match. According to an embodiment, this process includes causing the RF signal source (e.g., RF signal source 220, 520, FIGS. 2, 5) to supply a relatively low power RF signal through the variable impedance matching network to the electrode(s) (e.g., first electrode 240 or both electrodes 540, 550, FIGS. 2, 5), in block 812. The system controller may control the RF signal power level through control signals to the power supply and bias circuitry (e.g., circuitry 226, 526, FIGS. 2, 5), where the control signals cause the power supply and bias circuitry to provide supply and bias voltages to the amplifiers (e.g., amplifier stages 224, 225, 524, FIGS. 2, 5) that are consistent with the desired signal power level. For example, the relatively low power RF signal may be a signal having a power level in a range of about 10 W to about 20 W, although different power levels alternatively may be used. A relatively low power level signal during the match adjustment process 810 is desirable to reduce the risk of damaging the cavity or load (e.g., if the initial match causes high reflected power), and to reduce the risk of damaging the switching components of the variable inductance networks (e.g., due to arcing across the switch contacts).

In block 814, power detection circuitry (e.g., power detection circuitry 230, 530, 530', 530", FIGS. 2, 5) then measures the reflected and (in some embodiments) forward power along the transmission path (e.g., path 228, 528, FIGS. 2, 5) between the RF signal source and the electrode(s), and provides those measurements to the system controller. The system controller may then determine a ratio between the reflected and forward signal powers, and may determine the S11 parameter and/or VSWR value for the system based on the ratio. The system controller may store the received power measurements (e.g., the received reflected power measurements, the received forward power measurement, or both), and/or the calculated ratios, S11 parameters, and/or VSWR values for future evaluation or comparison, in an embodiment.

In block 816, the system controller may determine, based on the reflected power measurements, and/or the reflected-to-forward signal power ratio, and/or the S11 parameter, and/or the VSWR value, whether or not the match provided by the variable impedance matching network is acceptable (e.g., the reflected power is below a threshold, or the ratio is 10 percent or less, or the measurements or values compare favorably with some other criteria). Alternatively, the system controller may be configured to determine whether the match is the "best" match. A "best" match may be determined, for example, by iteratively measuring the reflected RF power (and in some embodiments the forward reflected RF power) for all possible impedance matching network configurations (or at least for a defined subset of impedance matching network configurations), and determining which configuration results in the lowest reflected RF power and/or the lowest reflected-to-forward power ratio.

When the system controller determines that the match is not acceptable or is not the best match, the system controller may adjust the match, in block 818, by reconfiguring the variable impedance matching network. For example, this may be achieved by sending control signals to the variable impedance matching network, which cause the network to increase and/or decrease the variable inductances within the network (e.g., by causing the variable inductance networks 310, 316, 611, 616, 621 (FIGS. 3, 6) or variable capacitance networks 442, 446, 711, 716, 721 (FIGS. 4, 7) to have different inductance or capacitance states, or by switching inductors or capacitors into or out of the circuit. After reconfiguring the variable inductance network, blocks 814, 816, and 818 may be iteratively performed until an acceptable or best match is determined in block 816.

Once an acceptable or best match is determined, the defrosting operation may commence. Commencement of the defrosting operation includes increasing the power of the RF signal supplied by the RF signal source (e.g., RF signal source 220, 520, FIGS. 2, 5) to a relatively high power RF signal, in block 820. Once again, the system controller may control the RF signal power level through control signals to the power supply and bias circuitry (e.g., circuitry 226, 526, FIGS. 2, 5), where the control signals cause the power supply and bias circuitry to provide supply and bias voltages to the amplifiers (e.g., amplifier stages 224, 225, 524, FIGS. 2, 5) that are consistent with the desired signal power level. For example, the relatively high power RF signal may be a signal having a power level in a range of about 50 W to about 500 W, although different power levels alternatively may be used.

In block 822, measurement circuitry (e.g., power detection circuitry 230, 530, 530', 530", FIGS. 2, 5) then periodically measures system parameters such as the one or more currents, one or more voltages, the reflected power and/or the forward power along the transmission path (e.g., path 228, 528, FIGS. 2, 5) between the RF signal source and the electrode(s), and provides those measurements to the system controller. The system controller again may determine a ratio between the reflected and forward signal powers, and may determine the S11 parameter and/or VSWR value for the system based on the ratio. The system controller may store the received power measurements, and/or the calculated ratios, and/or S11 parameters, and/or the VSWR values for future evaluation or comparison, in an embodiment. According to an embodiment, the periodic measurements of the forward and reflected power may be taken at a fairly high frequency (e.g., on the order of milliseconds) or at a fairly low frequency (e.g., on the order of seconds). For example, a fairly low frequency for taking the periodic measurements may be a rate of one measurement every 10 seconds to 20 seconds. According to an embodiment, the system controller may also determine the rate of change of one or more parameters such as the measured voltages, measured currents, the S11 parameter, the VSWR value (e.g., via comparison of the measurements or calculations of such parameters over a given time period). Based on this determined rate of change (e.g., if the rate of change exceeds a predefined threshold value), the system controller may determine that electrical arcing is at risk of occurring somewhere in the system.

In block 824, the system controller may determine, based on one or more reflected signal power measurements, one or more calculated reflected-to-forward signal power ratios, one or more calculated S11 parameters, and/or one or more VSWR values whether or not the match provided by the variable impedance matching network is acceptable. For example, the system controller may use a single reflected signal power measurement, a single calculated reflected-to-forward signal power ratio, a single calculated S11 parameter, or a single VSWR value in making this determination, or may take an average (or other calculation) of a number of previously-received reflected signal power measurements, previously-calculated reflected-to-forward power ratios, previously-calculated S11 parameters, or previously-calculated VSWR values in making this determination. To determine whether or not the match is acceptable, the system controller may compare the received reflected signal power, the calculated ratio, S11 parameter, and/or VSWR value to one or more corresponding thresholds, for example. For example, in one embodiment, the system controller may compare the received reflected signal power to a threshold of, for example, 5 percent (or some other value) of the forward signal power. A reflected signal power below 5 percent of the forward signal power may indicate that the match remains acceptable, and a ratio above 5 percent may indicate that the match is no longer acceptable. In another embodiment, the system controller may compare the calculated reflected-to-forward signal power ratio to a threshold of 10 percent (or some other value). A ratio below 10 percent may indicate that the match remains acceptable, and a ratio above 10 percent may indicate that the match is no longer acceptable. When the measured reflected power, the calculated ratio or S11 parameter, or the VSWR value is greater than the corresponding threshold (i.e., the comparison is unfavorable), indicating an unacceptable match, then the system controller may initiate re-configuration of the variable impedance matching network by again performing process 810.

As discussed previously, the match provided by the variable impedance matching network may degrade over the course of a defrosting operation due to impedance changes of the load (e.g., load 264, 564, FIGS. 2, 5) as the load warms up. It has been observed that, over the course of a defrosting operation, an optimal cavity match may be maintained by adjusting the cavity match inductance or capacitance and by also adjusting the RF signal source inductance or capacitance.

According to an embodiment, in the iterative process 810 of re-configuring the variable impedance matching network, the system controller may take into consideration this tendency. More particularly, when adjusting the match by reconfiguring the variable impedance matching network in block 818, the system controller initially may select states of the variable inductance networks for the cavity and RF signal source matches that correspond to lower inductances (for the cavity match, or network 310, FIG. 3) and higher inductances (for the RF signal source match, or network 442, FIG. 4). Similar processes may be performed in embodiments that utilize variable capacitance networks for the cavity and RF signal source. By selecting impedances that tend to follow the expected optimal match trajectories, the time to perform the variable impedance matching network reconfiguration process 810 may be reduced, when compared with a reconfiguration process that does not take these tendencies into account. In an alternate embodiment, the system controller may instead iteratively test adjacent configurations to attempt to determine an acceptable configuration.

In actuality, there are a variety of different searching methods that the system controller may employ to reconfigure the system to have an acceptable impedance match, including testing all possible variable impedance matching network configurations. Any reasonable method of searching for an acceptable configuration is considered to fall within the scope of the inventive subject matter. In any event, once an acceptable match is determined in block 816, the defrosting operation is resumed in block 814, and the process continues to iterate.

Referring back to block 824, when the system controller determines, based on one or more reflected power measurements, one or more calculated reflected-to-forward signal power ratios, one or more calculated S11 parameters, and/or one or more VSWR values that the match provided by the variable impedance matching network is still acceptable (e.g., the reflected power measurements, calculated ratio, S11 parameter, or VSWR value is less than a corresponding threshold, or the comparison is favorable), the system may evaluate whether or not an exit condition has occurred, in block 826. In actuality, determination of whether an exit condition has occurred may be an interrupt driven process that may occur at any point during the defrosting process. However, for the purposes of including it in the flowchart of FIG. 8, the process is shown to occur after block 824.

In any event, several conditions may warrant cessation of the defrosting operation. For example, the system may determine that an exit condition has occurred when a safety interlock is breached. Alternatively, the system may determine that an exit condition has occurred upon expiration of a timer that was set by the user (e.g., through user interface 280, 580, FIGS. 2, 5) or upon expiration of a timer that was established by the system controller based on the system controller's estimate of how long the defrosting operation should be performed. As another example, the system may determine that electrical arcing (e.g., in a variable matching network such as network 270, 300, 400, 572, 600, 700, FIGS. 2-7) is at risk of occurring in the system (e.g., due to an identified over-voltage condition), which may trigger an exit condition. For example, the system controller and power detection circuitry may detect a change in impedance between the RF signal source and the electrode(s) due to the voltage across a non-linear device in the variable impedance matching network exceeding a breakdown voltage for that non-linear device, and the exit condition may be triggered in response. In some embodiments, this determination may be made at block 822, and may cause the method to jump directly to block 828 to cease the supply of the RF signal, skipping blocks 824 and 826. In still another alternate embodiment, the system may otherwise detect completion of the defrosting operation.

If an exit condition has not occurred, then the defrosting operation may continue by iteratively performing blocks 822 and 824 (and the matching network reconfiguration process 810, as necessary). When an exit condition has occurred, then in block 828, the system controller causes the supply of the RF signal by the RF signal source to be discontinued. For example, the system controller may disable the RF signal generator (e.g., RF signal generator 222, 522, FIGS. 2, 5) and/or may cause the power supply and bias circuitry (e.g., circuitry 226, 526, FIGS. 2, 5) to discontinue provision of the supply current. In addition, the system controller may send signals to the user interface (e.g., user interface 280, 580, FIGS. 2, 5) that cause the user interface to produce a user-perceptible indicia of the exit condition (e.g., by displaying "door open" or "done" on a display device, or providing an audible tone). The method may then end.

It should be understood that the order of operations associated with the blocks depicted in FIG. 8 corresponds to an example embodiment, and should not be construed to limit the sequence of operations only to the illustrated order. Instead, some operations may be performed in different orders, and/or some operations may be performed in parallel.

The build-up of a voltage between two points generally results in electrical arcing when the voltage is sufficient to create an electric field between the two points that is strong enough to break down air (e.g., an electric field of about $3\times10^6$ V/m), causing the air to become partially conductive. High voltage circuit applications (e.g., defrosting applications that use high voltage RF signals) may generally be at risk for such electrical arcing. For example, voltage may build up at inductive and capacitive components (e.g., the inductances and capacitances of networks 270, 300, 400, 572, 600, 700, FIGS. 2-7) of a system (e.g., system 100, 200, 500, FIGS. 1, 2, 5) coupled along a transmission path between an RF signal source (e.g., RF signal source 220, 520, FIGS. 2, 5) and a load (e.g., cavity 260, 560, FIGS. 2, 5; and load 264, 564, FIGS. 2, 5) as the RF signal source supplies an RF signal to the load. In order to proactively prevent arcing from occurring, non-linear devices such as gas discharge tubes, spark gaps, and/or TVS diodes may be placed in parallel with circuit components coupled along the transmission path, as part of a variable impedance matching network, for example (e.g., variable impedance matching network 270, 300, 400, 572, 600, 700, FIGS. 2-7), or between any two points at which electrical arcing is likely to occur. If the voltage across one of these non-linear devices exceeds a breakdown voltage for that non-linear device, the non-linear device transitions from being electrically insulating (e.g., having a high impedance) to being electrically conductive (e.g., having a low impedance), causing a rapid change in the overall impedance of the transmission path between the RF signal source and the load. For example, a given non-linear device may have a lower breakdown voltage than the voltage level required for arcing to occur at a corresponding circuit component with which the non-linear device is coupled in parallel, so that the non-linear device begins conducting before electrical arcing can occur at the corresponding circuit component. A system controller (e.g., system controller 212, 512, FIGS. 2, 5) may monitor the rate of change of signal parameters (e.g., S11 parameters, VSWR, current, etc.) by which changes in the impedance of the transmission path between the RF source and the load (e.g., the rapid change in overall impedance caused by the voltage across a non-linear device exceeding its breakdown voltage) may be represented, the rate of change being derived from measurements made by power detection circuitry (e.g., power detection circuitry 230, 530, 530', 530", FIGS. 2, 5) coupled to one or more outputs of the RF signal source, in an embodiment. If the rate of change of the monitored signal parameter exceeds a predetermined threshold, the system controller may cause the operation of the system to be modified (e.g., by reconfiguring the variable impedance matching network, by reducing the power of the RF signal, or by causing the RF signal source to stop supplying the RF signal) to reduce the voltage across the non-linear device that has become conductive back below its corresponding breakdown voltage, until the non-linear device becomes insulating again, preventing uncontrolled electrical arcing form occurring at that location. Examples of how non-linear devices may be placed in different configurations of variable impedance matching networks are shown in FIGS. 3, 4, 6, and 7, as previously described.

During normal operation (e.g., corresponding to at least blocks 820-826, FIG. 8) of a defrosting system (e.g., defrosting system 100, 200, 500, FIGS. 1, 2, 5), signal parameters (e.g., S11 parameters, VSWR, current, etc.) and impedance for a variable impedance matching network (e.g., variable impedance matching network 300, 400, 600, 700, FIGS. 3, 4, 6, 7) may change gradually (e.g., over the course of several seconds) as RF energy is applied to a load, due to corresponding changes to the impedance of the load. In contrast, the above-described change in the S11 parameter (or VSWR) and impedance from an impedance matched condition to mismatched condition may occur quickly (e.g., in less than a fraction of one second) from the when the voltage across a non-linear device (e.g., non-linear device 1502, 1504, 1506, 1508, 1510, 1512, 1602, 1604, 1606, 1608, 1610, 1612, 1614, 1702, 1704, 1706, 1708, 1802, 1804, 1806, 1808, 1810, FIGS. 3, 4, 6, 7) of the variable impedance matching network exceeds a breakdown voltage of that non-linear device. Thus, the rate of change of one or more of the signal parameters may be used as a basis for determining whether electrical arcing is at risk of occurring in the defrosting system so that preventative modification of the system may be taken, in an embodiment.

Figure 9:
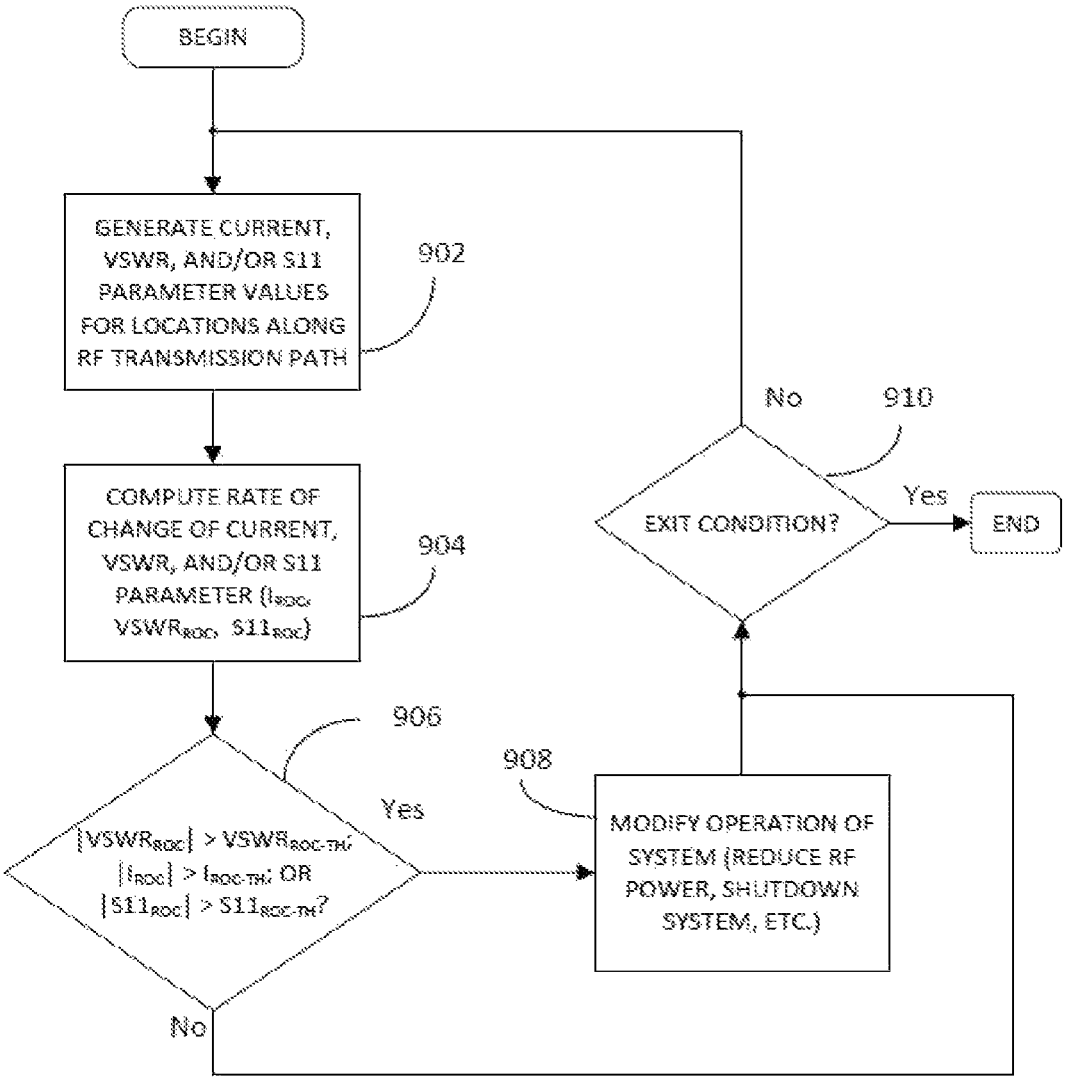
FIG. 9 is a flowchart of a method of detecting an overvoltage condition in a matching network and, in response, modifying an operation of an RF signal source to prevent electrical arcing, in accordance with an example embodiment.

An example of a method by which a system controller (e.g., system controller 212, 512, FIGS. 2, 5) of a defrosting system may monitor respective rates of change of, a current, the VSWR, and/or the S11 parameter for a variable impedance matching circuit (e.g., variable impedance matching circuits 300, 400, 600, 700, FIGS. 3, 4, 6, 7) of the defrosting system in order to detect and respond to the voltage across a non-linear device (e.g., non-linear device 1502, 1504, 1506, 1508, 1510, 1512, 1602, 1604, 1606, 1608, 1610, 1612, 1614, 1702, 1704, 1706, 1708, 1802, 1804, 1806, 1808, 1810, FIGS. 3, 4, 6, 7) of the variable impedance matching circuit (or elsewhere in an RF signal path) exceeding a breakdown voltage of that non-linear device is shown in FIG. 9. In some embodiments, the method of FIG. 9 may be performed in conjunction with the method of FIG. 8. For example, blocks 902, 904, 906, and 908 may be performed at block 822 of FIG. 8, and block 910 may be performed at block 826 of FIG. 8.

In block 902, one or more types of measurement circuitry (e.g., voltmeter, ammeter, power detection circuitry) may be used to periodically produce a plurality of VSWR measurements, current measurements, and S11 parameter measurements (e.g., which may collectively be considered measurements of "signal parameters" of the defrosting system) at the output of an RF signal source (e.g., RF signal source 220, 520, FIGS. 2, 5) that supplies an RF signal. For example, an ammeter may be used to measure the current at the output of the RF signal source that is coupled to the variable impedance matching network to generate a current measurement. Power detection circuitry (e.g., power detection circuitry 230, 530, 530', 530", FIGS. 2, 5) may be used to measure forward and reflected RF signal power along the RF signal path, and the system controller may calculate the S11 parameter measurement as a ratio of the reflected RF signal power to the forward RF signal power, and may calculate the VSWR measurement from the S11 parameter measurement. In order to generate a plurality of measurements over time, these VSWR, current, and/or S11 measurements and calculations may be performed on a periodic basis (e.g., at a predetermined sampling rate between about 100 microseconds and 100 milliseconds, or at a lower or higher sampling rate).

In block 904 the system controller computes the rate of change of the VSWR ($VSWR_{ROC}$), the current ($I_{ROC}$), and the S11 parameter ($S11_{ROC}$) based on the measurements taken in block 902 and based on the sampling rate. For example, the $S11_{ROC}$ of the variable impedance matching network may be determined by the system controller of the defrosting system based on S11 parameter measurements stored in a memory of the system controller, where each S11 parameter measurement stored in the memory may correspond to the S11 parameter of the variable impedance matching network at a different point in time. As indicated in the description of block 902, above, the system controller may, for example, determine (e.g., collect, calculate, or otherwise sample) and store the S11 parameter measurements for the variable impedance matching network at the predetermined sampling rate (e.g., at a predetermined sampling rate between about 10 milliseconds and 2 second, or at a lower or higher sampling rate). S11 parameter measurements generated via this sampling may then be provided the memory, which may store the S11 parameter measurements. The system controller may then, for example, calculate the rate of change of the S11 parameter by determining a first difference between first and second S11 parameter measurements, determining a second difference between first and second times at which the first and second S11 parameter measurements were measured, and dividing the first difference by the second difference to produce the rate of change of the S11 parameter of the variable impedance matching network. $I_{ROC}$ and $VSWR_{ROC}$ may be calculated according to the preceding example, with first and second current measurements and first and second VSWR measurements, being used in place of the first and second S11 parameters when determining $I_{ROC}$ and $VSWR_{ROC}$, respectively. Further, more than two S11, VSWR, or current measurements may be used to calculate the rate of change, in some embodiments.

At block 906, the system controller compares the magnitudes of $VSWR_{ROC}$, $I_{ROC}$, and $S11_{ROC}$ to corresponding thresholds in order to determine whether the $VSWR_{ROC}$, $I_{ROC}$, or $S11_{ROC}$ magnitudes exceed any of these thresholds. For example, the system controller may compare the magnitude of $VSWR_{ROC}$ to a predefined VSWR rate of change threshold value, $VSWR_{ROC\text{-}TH}$ (e.g., a value of approximately 3:1 or another threshold having a greater or lesser value). The system controller may also or alternatively compare the magnitude of $I_{ROC}$ to a predefined current rate of change threshold value, $I_{ROC\text{-}TH}$ (e.g., a value of approximately 1.4 that of nominal operation or another threshold having a greater or lesser value) or another threshold having a greater or lesser value). The system controller may also or alternatively compare the magnitude of $S11_{ROC}$ to a predefined S11 parameter rate of change threshold value, $S11_{ROC\text{-}TH}$. For example, $S11_{ROC\text{-}TH}$ may be a value between about 6 dB to about 9 dB return loss, although the threshold may be a smaller or larger value, as well. If the magnitude of $V_{ROC}$ exceeds $V_{ROC\text{-}TH}$, if the magnitude of $I_{ROC}$ exceeds $I_{ROC\text{-}TH}$, or if the magnitude of $S11_{ROC}$ exceeds $S11_{ROC\text{-}TH}$, then the system controller may determine that the voltage across a non-linear device somewhere along the transmission path has exceeded the breakdown voltage for that non-linear device and is approaching a magnitude at which arcing could occur, and may proceed to block 908. Otherwise, if none of the threshold values are exceeded, the system controller may determine that, because the voltages across the non-linear devices along the transmission path have not exceeded the breakdown voltages of any of those non-linear devices, an arcing condition is not likely to occur, and the system controller may skip block 908 and proceed to block 910.

In block 908, in response to determining that the rate of change of the current, VSWR, or S11 parameter has exceeded a corresponding predefined threshold value (and thus that an arcing condition likely to occur if the voltage at that location continues to increase), the system controller may modify an operation of the defrosting system in order to attempt to prevent the arcing from occurring in the defrosting system. For example, the system controller may instruct the RF signal source to reduce the power level of the RF signal it is supplying. In some embodiments, the power level of the RF signal may be reduced by up to 20 percent, while in other embodiments, the power level of the RF signal may be reduced more significantly (e.g., between 20 and 90 percent, such as to 10 percent of the originally applied power level of the RF signal). Alternatively, the system controller may shut down the system, or may otherwise instruct the RF signal source to stop generating the RF signal, thereby ending the defrosting operation. In another embodiment, the system controller may alter the configuration of the variable matching network by changing values of the variable passive components within the variable matching network.

At block 910, if for any reason the defrosting operation has been ended (e.g., due to modification of the defrosting operation by the system controller in response to detecting a rapid change in signal parameters, or due to successful completion of the defrosting operation), the system controller may cease monitoring the rates of change of the VSWR, current, and S11 parameter, and the method may end. Alternatively, when the system controller determines that the defrosting operation is continuing to occur, the method may return to block 902. In this way, an iterative loop may be performed that includes blocks 902-910, whereby the VSWR, current, and S11 parameter of the defrosting system and respective rates of change thereof may be continuously monitored to detect that the breakdown voltage of a non-linear device in the transmission path has been exceeded, and whereby the operation of the defrosting system may be modified in response.

The connecting lines shown in the various figures contained herein are intended to represent exemplary functional relationships and/or physical couplings between the various elements. It should be noted that many alternative or additional functional relationships or physical connections may be present in an embodiment of the subject matter. In addition, certain terminology may also be used herein for the purpose of reference only, and thus are not intended to be limiting, and the terms "first", "second" and other such numerical terms referring to structures do not imply a sequence or order unless clearly indicated by the context.

As used herein, a "node" means any internal or external reference point, connection point, junction, signal line, conductive element, or the like, at which a given signal, logic level, voltage, data pattern, current, or quantity is present. Furthermore, two or more nodes may be realized by one physical element (and two or more signals can be multiplexed, modulated, or otherwise distinguished even though received or output at a common node).

The foregoing description refers to elements or nodes or features being "connected" or "coupled" together. As used herein, unless expressly stated otherwise, "connected" means that one element is directly joined to (or directly communicates with) another element, and not necessarily mechanically. Likewise, unless expressly stated otherwise, "coupled" means that one element is directly or indirectly joined to (or directly or indirectly communicates with) another element, and not necessarily mechanically. Thus, although the schematic shown in the figures depict one exemplary arrangement of elements, additional intervening elements, devices, features, or components may be present in an embodiment of the depicted subject matter.

In an example embodiment, a system may include a radio frequency (RF) signal source configured to supply an RF signal, a transmission path electrically coupled between the RF signal source and a load, a variable impedance network that is coupled along the transmission path between the RF signal source and the load, a non-linear device coupled in parallel with at least one component of the variable impedance network, and a controller. The non-linear device may have a high impedance below a breakdown voltage and a low impedance above the breakdown voltage. The controller may be configured to detect a potential electrical arcing condition along the transmission path when the breakdown voltage of the non-linear device has been exceeded based on at least a rate of change of a parameter of the RF signal.

In an embodiment, the non-linear device may be selected from the group consisting of a gas discharge tube, a spark gap, and a transient-voltage-suppression diode.

In an embodiment, the non-linear device may be coupled in parallel with an inductor of the variable impedance network.

In an embodiment, the non-linear device may be coupled in parallel with a capacitor of the variable impedance network.

In an embodiment, the parameter may include at least one of the group consisting of a voltage standing wave ratio measured along the transmission path, a current measured along the transmission path, and a reflected-to-forward RF signal power ratio measured along the transmission path.

In an embodiment, the controller may be configured to detect that the breakdown voltage of the non-linear device has been exceeded by determining that the rate of change of the parameter exceeds a predefined threshold.

In an embodiment, the controller may be configured to modify operation of the system when the controller has detected the potential electrical arcing condition by reducing a power level of the RF signal supplied by the RF signal source.

In an example embodiment, a thermal increase system coupled to a cavity for containing a load may include an RF signal source configured to supply an RF signal, a transmission path electrically coupled between the RF signal source and one or more electrodes that are positioned proximate to the cavity, an impedance matching network coupled along the transmission path, measurement circuitry coupled to the transmission path, and a controller. The impedance matching network may include a network of variable passive components and at least one non-linear device coupled to at least one of the variable passive components. The at least one non-linear device may be electrically insulating below a breakdown voltage, and electrically conductive above the breakdown voltage. The measurement circuitry may periodically measure a parameter of the RF signal conveyed along the transmission path, resulting in a plurality of parameter measurements. Changes in an impedance of the impedance matching network may correlate with changes in the parameter. The controller may be configured to determine a rate of change of the parameter based on the plurality of parameter measurements, and to modify operation of the thermal increase system based on a rate of change of the parameter.

In an embodiment, the at least one non-linear device may be selected from a group consisting of a gas discharge tube, a spark gap, and a transient-voltage-suppression diode.

In an embodiment, the at least one non-linear device includes a non-linear device that is coupled in parallel with a variable inductor of the network of variable passive components.

In an embodiment, the non-linear device may include a non-linear device that is coupled in parallel with a variable capacitor of the network of variable passive components. The breakdown voltage of the non-linear device may be a fraction of a maximum voltage of the variable capacitor.

In an embodiment, the measurement circuitry may be configured to measure the parameter. The parameter may be selected from the group consisting of a voltage standing wave ratio, a current, and a reflected-to-forward RF signal power ratio.

In an embodiment, the controller may be configured to modify operation of the thermal increase system by performing an action selected from the group consisting of controlling the RF signal source to decrease a power level of the RF signal supplied by the RF signal source, and controlling the RF signal source to stop supplying the RF signal.

In an embodiment, the at least one non-linear device may include a first non-linear device, a second non-linear device, and a third non-linear device. The impedance matching network may be a double-ended variable impedance matching network that includes first and second inputs, first and second outputs, a first variable impedance circuit coupled between the first input and the first output, a second variable impedance circuit coupled between the second input and the second output, and a third variable impedance circuit coupled between the first input and the second input. The first non-linear device may be coupled in parallel with the first variable impedance circuit. The second non-linear device may be coupled in parallel with the second variable impedance circuit. The third non-linear device may be coupled in parallel with the second variable impedance circuit.

In an embodiment, the at least one non-linear device may include a plurality of non-linear devices. The impedance matching network may be a single-ended variable impedance matching network that includes an input, an output, a set of passive components coupled in series between the input and the output, and a variable impedance circuit coupled between the input and a ground reference node. Each passive component of the set of passive components may be coupled in parallel with respectively different non-linear devices of the plurality of non-linear devices. The variable impedance circuit may be coupled in parallel with an additional non-linear device of the plurality of non-linear devices.

In an example embodiment, a system may include an RF signal source configured to supply an RF signal, a load coupled to the RF signal source, a transmission path electrically coupled between the RF signal source and the load, a variable impedance network that is coupled along the transmission path between the RF signal source and the load, a plurality of non-linear devices electrically coupled to components of the variable impedance network, and a controller. Each non-linear devices of the plurality of non-linear devices may be electrically insulating below a breakdown voltage of that non-linear device and electrically above the breakdown voltage of that non-linear device. The controller may be configured to prevent electrical arcing from occurring along the transmission path by modifying an operation of the system in response to detecting that the breakdown voltage of at least one of the plurality of non-linear devices has been exceeded based on at least a rate of change of a parameter of the RF signal.

In an embodiment, the plurality of non-linear devices may be selected from the group consisting of a plurality of gas discharge tubes, a plurality of spark gaps, and a plurality of transient-voltage-suppression diodes.

In an embodiment, the parameter may include a reflected-to-forward signal power ratio. Modifying the operation of the system in response to detecting that the breakdown voltage of at least one of the plurality of non-linear devices has been exceeded may include reducing the power level of the one or more RF signals supplied by the RF signal source in response to detecting that a rate of change of the reflected-to-forward signal power ratio exceeds a predetermined threshold.

In an embodiment, the system may include measurement circuitry coupled to the transmission path at an output of the RF signal source. The measurement circuitry may periodically measure the parameter of the RF signal conveyed along the transmission path. Changes in the impedance of the variable matching network correlate with changes in the parameter.

While at least one exemplary embodiment has been presented in the foregoing detailed description, it should be appreciated that a vast number of variations exist. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A system comprising:

a radio frequency (RF) signal source configured to supply an RF signal;

a transmission path electrically coupled between the RF signal source and a load;

a variable impedance network that is coupled along the transmission path between the RF signal source and the load;

a non-linear device coupled in parallel with at least one component of the variable impedance network, the non-linear device having a high impedance below a breakdown voltage and a low impedance above the breakdown voltage; and a controller configured to detect a potential electrical arcing condition along the transmission path when the breakdown voltage of the non-linear device has been exceeded based on at least a rate of change of a parameter of the RF signal.

2. The system of claim 1, wherein the non-linear device is selected from the group consisting of: a gas discharge tube, a spark gap, and a transient-voltage-suppression diode.

3. The system of claim 2, wherein the non-linear device is coupled in parallel with an inductor of the variable impedance network.

4. The system of claim 2, wherein the non-linear device is coupled in parallel with a capacitor of the variable impedance network.

5. The system of claim 1, wherein the parameter comprises at least one of the group consisting of: a voltage standing wave ratio measured along the transmission path, a current measured along the transmission path, and a reflected-to-forward RF signal power ratio along the transmission path.

6. The system of claim 1, wherein the controller is configured to detect that the breakdown voltage of the non-linear device has been exceeded by determining that the rate of change of the parameter exceeds a predefined threshold.

7. The system of claim 1, wherein the controller is configured to modify operation of the system when the controller has detected the potential electrical arcing condition by reducing a power level of the RF signal supplied by the RF signal source.

8. A thermal increase system coupled to a cavity for containing a load, the thermal increase system comprising:

a radio frequency (RF) signal source configured to supply an RF signal;

a transmission path electrically coupled between the RF signal source and one or more electrodes that are positioned proximate to the cavity;

an impedance matching network electrically coupled along the transmission path, wherein the impedance matching network comprises a network of variable passive components and at least one non-linear device coupled to at least one of the variable passive components, the at least one non-linear device being electrically insulating below a breakdown voltage, and electrically conductive above the breakdown voltage;

measurement circuitry coupled to the transmission path, wherein the measurement circuitry periodically measures a parameter of the RF signal conveyed along the transmission path, resulting in a plurality of parameter measurements, wherein changes in an impedance of the impedance matching network correlate with changes in the parameter; and a controller configured to determine a rate of change of the parameter based on the plurality of parameter measurements, and to modify operation of the thermal increase system based on a rate of change of the parameter.

9. The thermal increase system of claim 8, wherein the at least one non-linear device is selected from the group consisting of: a gas discharge tube, a spark gap, and a transient-voltage-suppression diode.

10. The thermal increase system of claim 9, wherein the at least one non-linear device includes a non-linear device that is coupled in parallel with a variable inductor of the network of variable passive components.

11. The thermal increase system of claim 9, wherein the non-linear device includes a non-linear device that is coupled in parallel with a variable capacitor of the network of variable passive components, wherein the breakdown voltage of the non-linear device is a fraction of a maximum voltage of the variable capacitor.

12. The thermal increase system of claim 8, wherein the measurement circuitry is configured to measure the parameter, and wherein the parameter is selected from the group consisting of: a voltage standing wave ratio, a current, and a reflected-to-forward RF signal power ratio.

13. The thermal increase system of claim 12, wherein the controller is configured to modify operation of the thermal increase system by performing an action selected from the group consisting of: controlling the RF signal source to decrease a power level of the RF signal supplied by the RF signal source, and controlling the RF signal source to stop supplying the RF signal.

14. The thermal increase system of claim 8, wherein the at least one non-linear device includes a first non-linear device, a second non-linear device, and a third non-linear device, wherein the impedance matching network is a double-ended variable impedance matching network that comprises:

first and second inputs;

first and second outputs;

a first variable impedance circuit coupled between the first input and the first output, the first non-linear device coupled in parallel with the first variable impedance circuit;

a second variable impedance circuit coupled between the second input and the second output, the second non-linear device coupled in parallel with the second variable impedance circuit; and a third variable impedance circuit coupled between the first input and the second input, the third non-linear device coupled in parallel with the second variable impedance circuit.

15. The thermal increase system of claim 8, wherein the at least one non-linear device includes a plurality of non-linear devices, wherein the impedance matching network is a single-ended variable impedance matching network that comprises:

an input;

an output;

a set of passive components coupled in series between the input and the output, each passive component of the set of passive components being coupled in parallel with respectively different non-linear devices of the plurality of non-linear devices; and a variable impedance circuit coupled between the input and a ground reference node and coupled in parallel with an additional non-linear device of the plurality of non-linear devices.

16. A system comprising:

a radio frequency (RF) signal source configured to supply an RF signal;

a load coupled to the RF signal source;

a transmission path electrically coupled between the RF signal source and the load;

a variable impedance network that is coupled along the transmission path between the RF signal source and the load;

a plurality of non-linear devices electrically coupled to components of the variable impedance network, each non-linear device of the plurality of non-linear devices being electrically insulating below a breakdown voltage of that non-linear device and electrically above the breakdown voltage of that non-linear device; and a controller configured to prevent electrical arcing from occurring along the transmission path by modifying an operation of the system in response to detecting that the breakdown voltage of at least one of the plurality of non-linear devices has been exceeded based on at least a rate of change of a parameter of the RF signal.

17. The system of claim 16, wherein the plurality of non-linear devices is selected from the group consisting of: a plurality of gas discharge tubes, a plurality of spark gaps, and a plurality of transient-voltage-suppression diodes.

18. The method of claim 16, wherein the parameter comprises a reflected-to-forward signal power ratio, and wherein modifying the operation of the system in response to detecting that the breakdown voltage of at least one of the plurality of non-linear devices has been exceeded includes reducing the power level of the one or more RF signals supplied by the RF signal source in response to detecting that a rate of change of the reflected-to-forward signal power ratio exceeds a predetermined threshold.

19. The system of claim 16, further comprising:

measurement circuitry coupled to the transmission path at an output of the RF signal source, wherein the measurement circuitry periodically measures the parameter of the RF signal conveyed along the transmission path, and wherein changes in the impedance of the variable matching network correlate with changes in the parameter.

* * * * *